US010650840B1

(12) United States Patent
Solbach

(10) Patent No.: US 10,650,840 B1
(45) Date of Patent: May 12, 2020

(54) ECHO LATENCY ESTIMATION

(71) Applicant: Amazon Technologies, Inc., Seattle, WA (US)

(72) Inventor: Ludger Solbach, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 124 days.

(21) Appl. No.: 16/032,494

(22) Filed: Jul. 11, 2018

(51) Int. Cl.

| | |
|---|---|
| ***G10L 21/02*** | (2013.01) |
| ***G10L 21/0264*** | (2013.01) |
| ***G10L 21/0224*** | (2013.01) |
| *G10L 21/0216* | (2013.01) |
| *G10L 21/0208* | (2013.01) |

(52) U.S. Cl.
CPC ..... *G10L 21/0264* (2013.01); *G10L 21/0224* (2013.01); *G10L 2021/02082* (2013.01); *G10L 2021/02087* (2013.01); *G10L 2021/02163* (2013.01); *G10L 2021/02166* (2013.01)

(58) Field of Classification Search
None
See application file for complete search history.

(56) References Cited

U.S. PATENT DOCUMENTS 7,672,445 B1 * 3/2010 Zhang ..... H04M 9/082 370/286
2006/0083391 A1 * 4/2006 Nishida ..... H04S 7/301 381/96
2008/0198942 A1 * 8/2008 Akella ..... H04L 25/0232 375/260
2009/0168673 A1 * 7/2009 Kalampoukas ..... H04L 65/601 370/286
2010/0246804 A1 * 9/2010 Prakash ..... H04M 9/082 379/406.05
2014/0003611 A1 * 1/2014 Mohammad ..... H04R 3/005 381/66
2014/0010382 A1 * 1/2014 Jeong ..... G10K 11/16 381/66
2017/0310360 A1 * 10/2017 Gejo ..... H04B 3/237
2018/0352331 A1 * 12/2018 Kriegel ..... H04R 3/04

* cited by examiner

*Primary Examiner* — Neeraj Sharma
(74) *Attorney, Agent, or Firm* — Pierce Atwood LLP

(57) ABSTRACT

A device that determines an echo latency estimate by subsampling reference audio data. The device may determine the echo latency corresponding to an amount of time between sending reference audio data to loudspeaker(s) and microphone audio data corresponding to the reference audio data being received. The device may generate subsampled reference audio data by selecting only portions of the reference audio data that have a magnitude above a desired percentile. For example, the device may compare a magnitude of an individual reference audio sample to a percentile estimate value and sample only the reference audio samples that exceed the percentile estimate value. The device generate cross-correlation data between the subsampled reference audio data and the microphone audio data and may estimate the echo latency based on an earliest significant peak represented in the cross-correlation data.

20 Claims, 17 Drawing Sheets

Correlation Chart
210

Correlation Chart
220

Correlation Chart
230

ECHO LATENCY ESTIMATION

BACKGROUND

Systems may detect a delay or latency between when a reference signal is transmitted and when an "echo" signal (e.g., microphone audio data corresponding to the reference signal) is received. In audio systems, reference signals may be sent to loudspeakers and a microphone may recapture portions of the reference signal as the echo signal. In Radar or Sonar systems, a transmitter may send radio waves or sound waves and a receiver may detect reflections (e.g., echoes) of the radio waves or sound waves.

BRIEF DESCRIPTION OF DRAWINGS

For a more complete understanding of the present disclosure, reference is now made to the following description taken in conjunction with the accompanying drawings.

DETAILED DESCRIPTION

Figure 1:
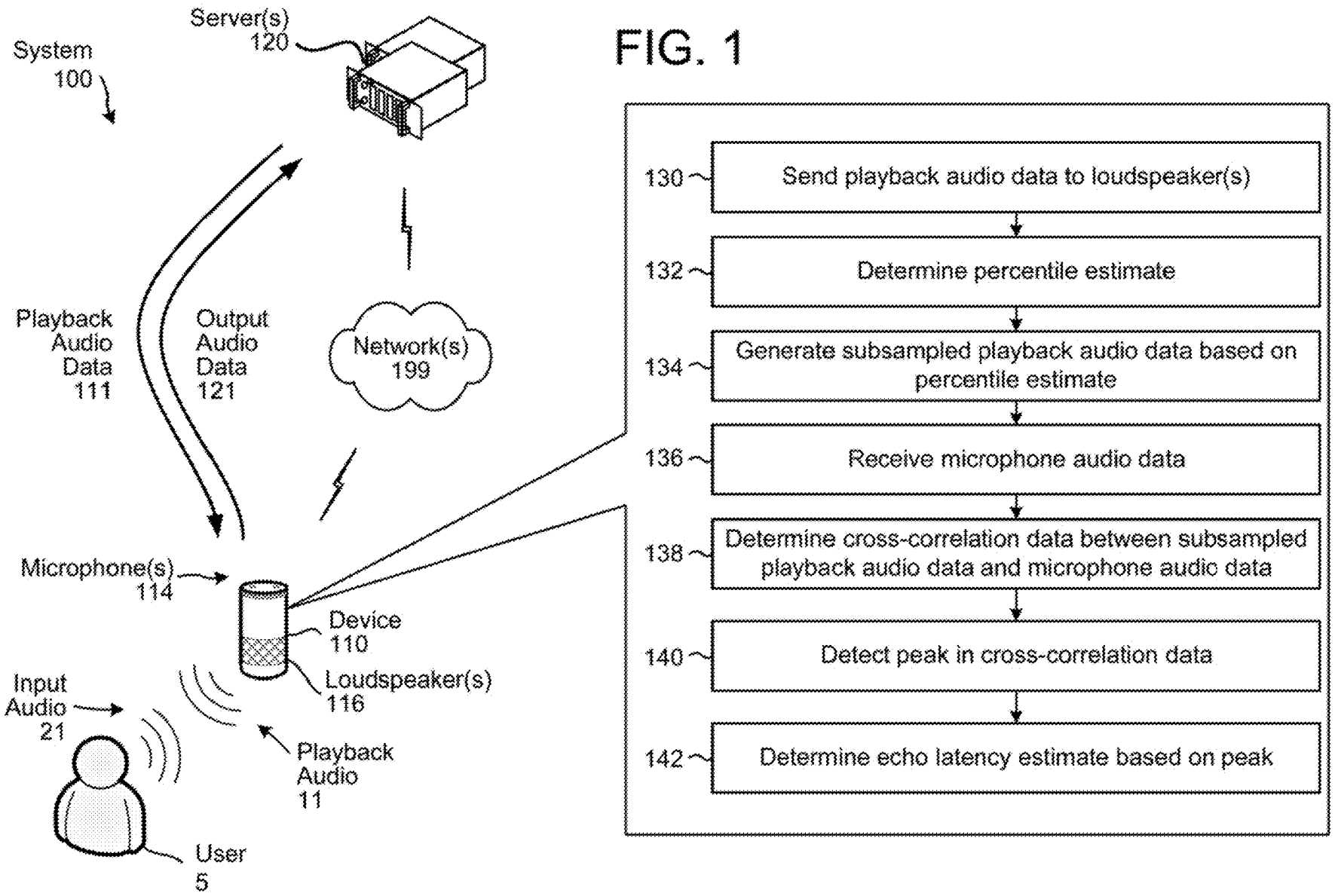
FIG. 1 illustrates a method for determining an echo latency estimate according to embodiments of the present disclosure.

Devices may perform signal matching to determine an echo latency between when a reference signal is transmitted and when an echo signal is received. The echo latency corresponds to a time difference between the reference signal and the echo signal and may indicate where the portions of the reference signal and the echo signal are matching. One technique for determining echo latency is to determine a cross-correlation between the reference signal (e.g., playback audio data sent to the loudspeaker) and an input signal (e.g., microphone audio data captured by a microphone) and detect a peak in the cross-correlation, with the echo latency corresponding to a time offset associated with the peak. However, generating a full cross-correlation may be processor intensive and require a large number of computations, as each sample in the reference signal is multiplied by each sample in the input signal. For example, for a 48 kHz reference signal and a one second search range, a full cross-correlation requires $48000^2$ multiplications per second (e.g., $2.3\times10^9$).

To improve echo latency estimation and reduce a processing requirement, offered is a device that subsamples the reference signal and performs a cross-correlation between the subsampled reference signal and the input signal. As high amplitude values of the reference signal are more important in detecting the peak in the cross-correlation and therefore estimating the echo latency, the device may subsample the reference signal such that the subsampled reference signal only includes samples from the reference signal associated with the highest amplitude values. For example, the device may generate a percentile estimate associated with a desired percentile (e.g., $95^{th}$ percentile, $99^{th}$ percentile, etc.) and may only select samples in the reference signal that exceed the percentile estimate. Thus, if the $99^{th}$ percentile is used, the device only selects 1/100 samples, reducing the processing consumption by 100. As a result, the device achieves a significant cost reduction via data-dependent, irregular downsampling of the reference signal, without affecting the precision by which the echo latency is estimated and/or the time resolution by which changes to the echo latency are tracked.

To summarize, the device improves a process of estimating an echo delay for purposes of acoustic echo cancellation when simultaneously trying to capture certain audio (such as a spoken utterance) while outputting other audio (like music). An echo delay is a latency between when a reference signal is sent to a loudspeaker and when an "echo" of the reference signal is represented in a microphone signal captured by a microphone. This echo delay is used to synchronize the reference signal with the microphone signal for acoustic echo cancellation and other processing. To reduce an amount of processing required to estimate the echo delay, the device subsamples the reference signal to generate a subsampled reference signal. The device may subsample the reference signal by estimating a magnitude value corresponding to a particular percentile (e.g., 99th percentile) in the reference signal and only selecting (e.g., "sampling") reference samples that exceed the estimated value. By updating the percentile estimate value over time, the device selects only 1% of the reference samples, thus reducing processing required to estimate the echo delay to 1/100 of what would otherwise have been needed.

FIG. 1 illustrates a method for determining an echo latency estimate (e.g., estimate of an echo path delay) according to embodiments of the present disclosure. As illustrated in FIG. 1, a system 100 may include one or more server(s) 120, one or more network(s) 199, and/or a device 110, which may include one or more microphone(s) 114 and one or more loudspeaker(s) 116.

The device 110 may be an electronic device configured to receive audio data from a remote device (e.g., the server(s) 120), to generate audio based on the audio data, and/or to capture, process and/or send audio data to remote devices (e.g., the server(s) 120). For example, the device 110 may receive playback audio data 111 from the server(s) 120, may generate playback audio 11 corresponding to the playback audio data 111 using the loudspeaker(s) 116, may capture microphone audio data using the microphone(s) 114, may generate output audio data 121, and may send the output audio data 121 to the server(s) 120.

As will be discussed in greater detail below, the system 100 may determine the echo latency estimate (e.g., estimated echo path delay) based on a cross-correlation. For example, the device 110 may perform latency detection by comparing two sets of signals and detecting how close they are to each other (e.g., determining a time difference between the two sets of signals). Conventional techniques determine a cross-correlation between the playback audio data 111 and the output audio data 121. However, as discussed above, generating a full cross-correlation may be processor intensive and require a large number of computations, as each sample in the reference signal is multiplied by each sample in the input signal. For example, for a 48 kHz reference signal and a one second search range, a full cross-correlation requires $48000^2$ multiplications per second (e.g., $2.3\times10^9$).

In the example illustrated in FIG. 1, the system 100 may reduce the number of computations and/or the processing required by subsampling the playback audio data 111 and estimating the echo latency using a cross-correlation between the subsampled playback audio data and the microphone audio data. As high amplitude values of the playback audio data 111 are more important in detecting the peak in the cross-correlation and therefore estimating the echo latency, the device 110 may subsample the playback audio data 111 such that the subsampled playback audio data only includes samples from the playback audio data 111 associated with the highest amplitude values. For example, the device 110 may generate a percentile estimate associated with a desired percentile (e.g., $95^{th}$ percentile, $99^{th}$ percentile, etc.) and may only select samples in the playback audio data 111 that exceed the percentile estimate. Thus, if the $99^{th}$ percentile is used, the device 110 only selects 1/100 samples, reducing the processing consumption by 100 (e.g., only requiring 1% of the computations necessary when using the playback audio data 111). As a result, the device 110 achieves a significant cost reduction via data-dependent, irregular downsampling of the reference signal, without affecting the precision by which the echo latency is estimated and/or the time resolution by which changes to the echo latency are tracked. Examples of how to generate the subsampled playback data will be described in greater detail below, following a brief description of how the device 110 performs audio processing to generate the output audio data 121.

A plurality of devices may communicate across the one or more network(s) 199. As illustrated in FIG. 1, the server(s) 120 may send playback audio data 111 to the device 110 and the device 110 may generate playback audio 11 (e.g., audible sound) via the loudspeaker(s) 116 based on the playback audio data 111. For example, the device 110 may be streaming music from the server(s) 120 and/or receiving audio from a remote user as part of a communication session (e.g., audio or video conversation). While generating the playback audio 11, a user 5 local to the device 110 may generate input audio 21 (e.g., an utterance) corresponding to speech. For example, the input audio 21 may correspond to a voice command (e.g., a request to perform an action by the device 110 and/or the server(s) 120) and/or speech intended for the remote user that is associated with the communication session.

The microphone(s) 114 may capture the input audio 21, along with an "echo" signal corresponding to the playback audio 11, as microphone audio data (not illustrated). For example, the microphone audio data may include a representation of the speech (e.g., input audio 21) along with a representation of the playback audio 11, which may correspond to a direct path between the loudspeaker(s) 116 and the microphone(s) 114 and/or indirect paths caused by acoustic reflections (e.g., playback audio 11 reflects off of surfaces like a wall). Thus, the microphone audio data may recapture portions of the playback audio data 111 that was used to generate the playback audio 11.

In audio systems, acoustic echo cancellation (AEC) processing refers to techniques that are used to recognize when the system 100 has recaptured sound via a microphone after some delay that the system 100 previously output via the loudspeakers 116. The system 100 may perform AEC processing by subtracting a delayed version of the original audio signal (e.g., playback audio data 111) from the captured audio (e.g., microphone audio data), producing a version of the captured audio that ideally eliminates the "echo" of the original audio signal, leaving only new audio information. For example, if someone were singing karaoke into a microphone while prerecorded music is output by a loudspeaker, AEC processing can be used to remove any of the recorded music from the audio captured by the microphone, allowing the singer's voice to be amplified and output without also reproducing a delayed "echo" of the original music. As another example, a media player that accepts voice commands via a microphone can use AEC processing to remove reproduced sounds corresponding to output media that are captured by the microphone, making it easier to process input voice commands.

The device 110 may perform audio processing on the microphone audio data to generate output audio data 121 to send to the server(s) 120. For example, the device 110 may perform AEC processing, residual echo suppression (RES), and/or other audio processing known to one of skill in the art to improve the audio signal and isolate portions of the microphone audio data that correspond to the input audio 21, as will be discussed in greater detail below.

An audio signal is a representation of sound and an electronic representation of an audio signal may be referred to as audio data, which may be analog and/or digital without departing from the disclosure. For ease of illustration, the disclosure may refer to either audio data (e.g., reference audio data or playback audio data, microphone audio data or input audio data, etc.) or audio signals (e.g., playback signals, microphone signals, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

As used herein, audio data (e.g., playback audio data, microphone audio data, or the like) may correspond to a specific range of frequency bands. For example, playback audio data and/or microphone audio data may correspond to a human hearing range (e.g., 20 Hz-20 kHz), although the disclosure is not limited thereto.

Playback audio data (e.g., playback audio data 111) corresponds to audio data that will be output by the loudspeaker(s) 116 to generate playback audio (e.g., playback audio 11). For example, the device 110 may stream music or output speech associated with a communication session (e.g., audio or video telecommunication). As the playback audio data is used as a reference for audio processing such as acoustic echo cancellation (AEC) processing, the playback audio data may be referred to as reference audio data without departing from the disclosure, and one of skill in the art will recognize that playback/reference audio data may also be referred to as far end audio data, loudspeaker data, and/or the like. For ease of illustration, the following description will refer to playback audio data and reference audio data interchangeably, with playback audio data being used more frequently when referring to generating output audio using the loudspeaker(s) 116 and reference audio data being used more frequently when referring to performing AEC processing or the like. As noted above, the playback/reference audio data may be referred to as playback/reference signal(s) (e.g., playback signal x(t)) without departing from the disclosure.

Microphone audio data corresponds to audio data that is captured by the microphone(s) 114 prior to the device 110 performing audio processing such as AEC processing. The microphone audio data may include local speech s(t) (e.g., an utterance, such as input audio 21), an "echo" signal y(t) (e.g., portion of the playback audio 11 captured by the microphone(s) 114), acoustic noise n(t) (e.g., ambient noise in an environment around the device 110), and/or the like. As the microphone audio data is captured by the microphone(s) 114 and captures audio input to the device 110, the microphone audio data may be referred to as input audio data without departing from the disclosure, and one of skill in the art will recognize that microphone/input audio data may also be referred to as a near end audio data and/or the like. For ease of illustration, the following description will refer to microphone audio data and input audio data interchangeably, although microphone audio data will be used more frequently to avoid confusion (e.g., to avoid ambiguity about which audio data received by the device 110 is "input" audio data). As noted above, the input/microphone audio data may be referred to as microphone/input signal(s) (e.g., microphone signal z(t)) without departing from the disclosure.

An "echo" signal y(t) corresponds to a portion of the playback audio 11 that reaches the microphone(s) 114 (e.g., portion of audible sound(s) output by the loudspeaker(s) 116 that is recaptured by the microphone(s) 114) and may be referred to as an echo or echo data y(t). The echo signal y(t) can be characterized based on a transfer function. For example, a first portion of the playback audio data output by the loudspeaker(s) 114 and captured by a first microphone 114*a* can be characterized (e.g., modeled) using a first transfer function $h_{a1}(n)$ and a second portion of the playback audio data output by the loudspeaker(s) 114 and captured by a second microphone 114*b* can be characterized using a second transfer function $h_{a2}(n)$. Thus, a number of transfer functions may vary depending on the number of loudspeaker(s) 114 and/or microphone(s) 114 without departing from the disclosure. The transfer functions h(n) vary with the relative positions of the components and the acoustics of the room (e.g., environment surrounding the device 110). If the position of all of the objects in the room are static, the transfer functions h(n) are likewise static. Conversely, if the position of an object in the room changes, the transfer functions h(n) may change.

To isolate the local speech s(t) included in the microphone audio data z(t), the device 110 may perform acoustic echo cancellation (AEC) processing or the like to "remove" the echo signal y(t) from the microphone audio data z(t) and generate output audio data. As the device 110 does not know the exact echo signal y(t) included in the microphone audio data z(t), the device 110 may generate an echo estimate signal y'(t) (e.g., estimate of the echo signal) using the playback audio data and transfer function(s) h(n) and may "remove" the echo estimate signal y'(t) by subtracting the echo estimate signal y'(t) from the microphone audio data z(t). For example, the device 110 may generate a first echo estimate signal $y_1'(t)$ based on the playback audio data and the first transfer function $h_{a1}(n)$ and may generate a second echo estimate signal $y_2'(t)$ based on the playback audio data and the second transfer function $h_{a2}(n)$. Thus, reference to removing the echo signal y(t) to generate the output audio data implies that the device 110 generates the echo estimate signal y'(t) and subtracts the echo estimate signal y'(t) from the microphone audio data z(t) in order to generate the output audio data. As noted above, the echo estimate signal may be referred to as echo estimate audio data y'(t) without departing from the disclosure.

Output audio data corresponds to audio data after the device 110 performs audio processing (e.g., AEC processing and/or the like) to isolate the local speech s(t). For example, the output audio data corresponds to the microphone audio data z(t) after subtracting the echo estimate signal y'(t), optionally removing and/or reducing the acoustic noise n(t) (e.g., using adaptive noise cancellation (ANC), acoustic interference cancellation (AIC), and/or the like), optionally performing residual echo suppression (RES), and/or other audio processing known to one of skill in the art. While the audio processing removes at least a portion of the echo estimate signal y'(t) and/or the acoustic noise n(t), the output audio data may still include a portion of the echo estimate signal y'(t) and/or the acoustic noise n(t) in addition to the local speech s(t). As noted above, the output audio data may be referred to as output audio signal(s) without departing from the disclosure, and one of skill in the art will recognize that the output audio data may also be referred to as an error audio data m(t), error signal m(t) and/or the like.

For ease of illustration, the following description may refer to generating the output audio data 121 by performing AEC processing. However, the disclosure is not limited thereto, and the device 110 may generate the output audio data 121 by performing other audio processing (e.g., RES processing, etc.) in addition to and/or instead of performing AEC. Additionally or alternatively, the disclosure is not limited to AEC and, in addition to or instead of performing AEC, the device 110 may perform other processing to remove or reduce unwanted speech $s_2(t)$ (e.g., speech associated with a second user), unwanted acoustic noise n(t), and/or estimate echo signals y'(t), such as adaptive noise cancellation (ANC), acoustic interference cancellation (AIC), and/or the like without departing from the disclosure.

In order to perform AEC and other audio processing, the device 110 may synchronize the playback audio data 111 with the microphone audio data by determining an echo latency estimate (e.g., estimate of the echo path delay). In the system 100 illustrated in FIG. 1, the echo latency estimate corresponds to an amount of time required for the playback audio 11 generated by the loudspeaker(s) 116 to travel to the microphone(s) 114 (e.g., either directly or reflected off of nearby surfaces). For example, the device 110 may send the playback audio data 111 (e.g., reference signal(s)) to the loudspeaker(s) 116, may generate playback audio 11 using the loudspeaker(s) 116, and may detect a portion of the playback audio 11 corresponding to the playback audio data 111 represented in the microphone audio data generated by the microphone(s) 114. Thus, after a delay corresponding to the echo latency, the microphone(s) 114 may capture the playback audio 11 output by the loudspeaker(s) 116.

The system 100 may determine the echo latency estimate (e.g., estimated echo path delay) based on a cross-correlation. For example, the device 110 may perform latency detection by comparing two sets of signals and detecting how close they are to each other (e.g., determining a time difference between the two sets of signals). In the example illustrated in FIG. 1, the echo (e.g., portions of the playback audio 11 output by the loudspeaker(s) 116) is captured along with an utterance (e.g., voice command represented by the input audio 21) and the system 100 may estimate the echo latency using a cross-correlation between the playback audio data 111 and the microphone audio data.

By correctly calculating the echo latency, the system 100 may correct for the echo latency and/or improve speech processing associated with the utterance by performing AEC and/or other audio processing. For example, the system 100 may use the echo latency to calculate parameters for AEC processing, such as a step size control parameter/value, a tail length value, a reference delay value, and/or additional information that improves performance of the AEC. The step size control regulates a weighting with which to update adaptive filters that are used to estimate an echo signal (e.g., undesired audio to remove during AEC). For example, a high step size value corresponds to larger changes in the adaptive filter coefficient values (e.g., updating more quickly based on an error signal), which results in the AEC converging faster (e.g., accurately estimating the echo signal such that output audio data only corresponds to the utterance). In contrast, a low step size value corresponds to smaller changes in the adaptive filter coefficient values (e.g., updating more slowly), which results in the AEC converging more slowly but reducing distortion in the output audio data during steady-state conditions (e.g., small variations in the echo signal). Thus, the step size control is used to determine how much to emphasize previous adaptive filter coefficient values relative to current adaptive filter coefficient values. The tail length (e.g., a filter length) configures an amount of history (e.g., an amount of previous values to include when calculating a current value) used to estimate the linear response. For example, a longer tail length corresponds to more previous adaptive filter coefficient values being used to determine a current adaptive filter coefficient value, whereas a lower tail length corresponds to fewer previous adaptive filter coefficient values being used. Finally, the reference delay (e.g., delay estimate) informs the system 100 the exact and/or approximate latency between the playback audio data 111 and the microphone audio data (e.g., microphone capture stream(s)) to enable the system 100 to align frames during AEC.

While not illustrated in FIG. 1, the loudspeaker(s) 116 may be separate from the device 110 without departing from the disclosure. Additionally or alternatively, the system 100 may include additional devices such as a television and/or an audio video receiver (AVR) (e.g., external device that performs additional audio processing prior to the loudspeaker(s) 116) without departing from the disclosure. Therefore, while FIG. 1 illustrates the device 110 directly connected to the loudspeaker(s) 116, this is intended for illustrative purposes only and the disclosure is not limited thereto. Instead, the device 110 may be connected to the loudspeaker(s) 116 via an external device, including the television, the AVR, and/or the like, without departing from the disclosure.

While FIG. 1 illustrates the device 110 sending the playback audio data to one or more loudspeaker(s) 116 included in the device 110, the disclosure is not limited thereto. Instead, the device 110 may send the playback audio data 111 to any number of loudspeakers 116, either included within the device 110 and/or external to the device 110, without departing from the disclosure. For example, the device 110 may send the playback audio data 111 to two loudspeakers 116 (e.g., stereo), five loudspeakers 116 (e.g., surround sound audio), six loudspeakers 116 (e.g., 5.1 surround sound), seven loudspeakers 116 (e.g., 6.1 surround sound), eight loudspeakers 116 (e.g., 7.1 surround sound), or the like without departing from the disclosure. In some examples, the device 110 may send first playback audio data corresponding to a first number of channels (e.g., first number of playback audio signals) to the AVR and the AVR may generate second playback audio data corresponding to a second number of channels (e.g., second number of playback audio signals). For example, the device 110 may send two channels of playback audio data to the AVR and the AVR may generate additional channels in order to send five channels to the loudspeaker(s) 116.

Similarly, while FIG. 1 illustrates the device receiving the microphone audio data from a single microphone 114, the disclosure is not limited thereto and the device 110 may receive microphone audio data from any number of microphones 114 without departing from the disclosure. In some examples, the device 110 may receive the microphone audio data from a microphone array including a plurality of microphones 114.

While FIG. 1 illustrates determining an echo latency estimate associated with audio signals being played through the loudspeaker(s) 116, the disclosure is not limited thereto. Instead, the techniques disclosed herein may be applied to other systems to provide latency estimation and/or signal matching in a variety of circumstances. For example, the device 110 may receive input data from multiple sensors and may determine how close the sensors are to each other based on the input data. Thus, the techniques disclosed herein are applicable to systems that use RAdio Detection And Ranging (RADAR) techniques, SOund Navigation And Ranging (SONAR) techniques, and/or other technology without departing from the disclosure. For example, the system may output a known signal of interest to a first device (e.g., loudspeaker, transmitting antenna, sound transmitter, etc.) at a first time and may generate input data using a second device (e.g., microphone, receiving antenna, receiver, etc.). In some examples, the first device and the second device may be the same device. For example, the same antenna may be used for transmitting and receiving using RADAR techniques. Using a cross-correlation between the known signal of interest and the input data, the system may determine when the known signal of interest is detected in the input data (e.g., the signal comes back or returns) at a second time and may determine a precise estimate of the delay between when the signal was sent and when the signal was received (e.g., amount of time elapsed between the first time and the second time). When implemented using RADAR or SONAR techniques, the echo latency estimate may be used to determine a precise location of an object relative to the receiving antenna/receiver. The system may determine a distance to the object (e.g., range), as well as an angle (e.g., bearing), velocity (e.g., speed), altitude, or the like associated with the object.

Although the figures and discussion of the present disclosure illustrate certain operational steps of the system in a particular order, the steps described may be performed in a different order (as well as certain steps removed or added) without departing from the intent of the disclosure.

As illustrated in FIG. 1, the device 110 may send (130) playback audio data to loudspeaker(s) 116 to generate the playback audio 11. The device 110 may determine (132) a percentile estimate and may generate (134) subsampled playback audio data based on the percentile estimate. For example, the device 110 may subsample the playback audio data using a desired percentile, selecting individual playback audio samples that are at or higher than the desired percentile. To illustrate an example, if the desired percentile is $95^{th}$ percentile, then the device 110 may subsample the playback audio data such that the subsampled playback audio data only includes playback audio samples in the $95^{th}$ percentile or higher, resulting in a 1/20 reduction in playback samples relative to the playback audio data. Similarly, if the desired percentile is $99^{th}$ percentile, then the device 110 may subsample the playback audio data such that the subsampled playback audio data only includes playback audio samples in the $99^{th}$ percentile or higher, resulting in a 1/100 reduction in playback samples relative to the playback audio data.

As will be described in greater detail below with regard to FIG. 5, the device 110 may generate the subsampled playback audio data by comparing a magnitude of individual playback audio samples (e.g., absolute value, square of the magnitude, etc.) to a corresponding percentile estimate value and selecting only the individual playback audio samples having a magnitude that exceeds the percentile estimate value. For example, the subsampled playback audio data may only include first playback audio samples that have a magnitude in the $99^{th}$ percentile (whether positive or negative), while second playback audio samples having a magnitude below the percentile estimate value are discarded. In addition, the device 110 may update the percentile estimate based on whether the individual playback audio sample exceeds the percentile estimate value. For example, the device 110 may decrease the percentile estimate by a first amount when a playback audio sample is below the percentile estimate value (e.g., for each of the second playback audio samples), and increase the percentile estimate by a second amount when the playback audio sample exceeds the percentile estimate value (e.g., for each of first playback audio samples).

After generating the subsampled playback audio data, the device 110 may receive (136) microphone audio data and determine (138) cross-correlation data by performing a cross-correlation between the subsampled playback audio data and the microphone audio data. For example, a single microphone 114, a plurality of microphones 114 and/or a microphone array may generate the microphone audio data, and the cross-correlation data may indicate a measure of similarity between the microphone audio data and the subsampled playback audio data as a function of the displacement of one relative to the other. The device 110 may determine the cross-correlation data using any techniques known to one of skill in the art (e.g., normalized cross-covariance function or the like) without departing from the disclosure.

To determine the cross-correlation data, the device 110 may multiply each individual subsampled audio sample included in the subsampled playback audio data by each individual microphone audio sample included in a frame of the microphone audio data. As the subsampled playback audio data includes a fraction of the playback audio data (e.g., using the $99^{th}$ percentile results in the subsampled playback audio data only including one out of every hundred playback audio samples from the playback audio data, for a 1/100 reduction in audio samples), determining the cross-correlation data using the subsampled playback audio data requires only a fraction of the processing necessary when using the full playback audio data.

The device 110 may detect (140) a peak represented in the cross-correlation data and may determine (142) an echo latency estimate based on the peak. For example, the device 110 may detect the peak by identifying data point(s) within a specific time range of the cross-correlation data having a highest magnitude (e.g., local maximum). The peak corresponds to a strong correlation between the subsampled playback audio data and the microphone audio data, indicating that the microphone audio data recaptured a portion of the subsampled playback audio data. The data point(s) associated with the peak indicate a magnitude along a vertical axis (e.g., y coordinate) and a time shift along a horizontal axis (e.g., x coordinate). Thus, the device 110 may determine the echo latency estimate based on the time shift (e.g., x coordinate) associated with the peak.

In some examples, the cross-correlation data may include only a single peak, which indicates a specific echo latency (e.g., echo path delay). For example, if the device 110 generates the playback audio 11 using only one loudspeaker 116 and/or using multiple loudspeakers 116 that are spaced close together, and there are no strong reflections (e.g., no acoustically reflective surfaces are present near the device 110 to reflect the playback audio 11 back to the device 110), the cross-correlation data may indicate that there is only one strong peak that may be used to estimate the echo latency. However, the disclosure is not limited thereto, and in other examples the cross-correlation data may include multiple peaks. For example, if there are repetitions in the playback audio 11 being output to the loudspeakers 116, the device 110 generates the playback audio 11 using multiple loudspeaker(s) 116 (e.g., multiple audio channels, which may correspond to external loudspeakers that are not illustrated in FIG. 1) and/or there are one or more strong reflections (e.g., caused by one or more acoustically reflective surfaces near the device 110 reflecting the playback audio 11 back to the device 110), the cross-correlation data may include two or more peaks.

If the device 110 sends the playback audio data to external loudspeakers that are spaced sufficiently apart, there may be a unique peak for each of the loudspeaker(s) 116. Thus, the cross-correlation data may include a first number of unique peaks that corresponds to a second number of loudspeakers 116. For example, if the system 100 sends the playback audio data to two loudspeakers 116, the cross-correlation data may include two peaks corresponding to locations where the playback audio data overlaps the microphone audio data for each of the two loudspeakers 116. Similarly, if the system 100 sends playback audio data to five loudspeakers 116, the cross-correlation data may include five peaks corresponding to locations where the playback audio data overlaps the microphone audio data for each of the five loudspeakers 116. If the cross-correlation data includes multiple peaks, the device 110 may determine the echo latency estimate based on an earliest significant peak in the cross-correlation data, which corresponds to the shortest echo path between one of the loudspeaker(s) 116 and the microphone(s) 114.

In order to correctly determine the echo latency estimate, the device 110 must determine whether a peak corresponds to the playback audio data or corresponds to noise and/or random repetitions in the playback audio 11 being output to the loudspeakers 116. For example, the device 110 may determine a maximum value of the cross-correlation data (e.g., magnitude of a highest peak, Peak A indicating a highest correlation between the signals) and determine a threshold value based on the maximum value. The device 110 may then work backwards in time to detect an earlier peak (e.g., Peak B, prior to Peak A), determine a maximum magnitude value associated with the earlier peak and determine whether the maximum magnitude value is above the threshold value. If the maximum magnitude value is below the threshold value, the device 110 may ignore the earlier peak (e.g., Peak B) and may select the highest peak (e.g., Peak A) as the earliest significant peak. If the maximum magnitude value is above the threshold value, the device 110 may select the earlier peak (e.g., Peak B) and repeat the process to determine if there is an even earlier peak (e.g., Peak C) and whether the even earlier peak exceeds the threshold value. If there isn't an earlier peak and/or the earlier peak does not exceed the threshold value (e.g., Peak C is below the threshold value), the device 110 may select Peak B as the earliest significant peak. If there is an earlier peak that exceeds the threshold value, the device 110 may repeat the process in order to detect the earliest significant peak (e.g., first unique peak that exceeds the threshold value).

After selecting the first significant peak, the device 110 may determine the echo latency estimate based on coordinates of the first significant peak. For example, a time index associated with the peak (e.g., coordinate along the x-axis of the cross-correlation data) may be used as the echo latency estimate.

While the examples described above illustrate determining the echo latency estimate based on an earliest significant peak, this corresponds to an instantaneous estimate. In some examples, the device 110 may estimate the latency using a two-stage process. For example, the device 110 may first compute the instantaneous estimate per cross-correlation as a first stage. Then, as a second stage, the device 110 may track the instantaneous estimates over time to provide a final reliable estimate. For example, the second stage may track two estimates, one based on an average of the instantaneous estimates and the other based on tracking any change in the estimate which could result due to framedrop conditions (e.g., audio samples being lost in transit to the loudspeaker(s) 116). The device 110 may switch to the new estimates once the device 110 is confident that the framedrop is for real and not due to peak shift due to the signal.

To illustrate an example, the device 110 may determine a series of instantaneous estimates. If the instantaneous estimates are consistent over a certain duration of time and within a range of tolerance, the device 110 may lock onto the measurement by calculating a final estimate. For example, the device 110 may calculate a final estimate of the echo latency using a moving average of the instantaneous estimates. However, if the instantaneous estimates are varying (e.g., inconsistent and/or outside of the range of tolerance), the device 110 may instead track an alternate measurement of the temporary estimation. Thus, the device 110 wants to ensure that if the instantaneous estimates are off-range of the estimated latency, the device 110 only calculates the final estimate based on the instantaneous estimates once the instantaneous estimates have been consistent for a certain duration of time.

Figure 2:
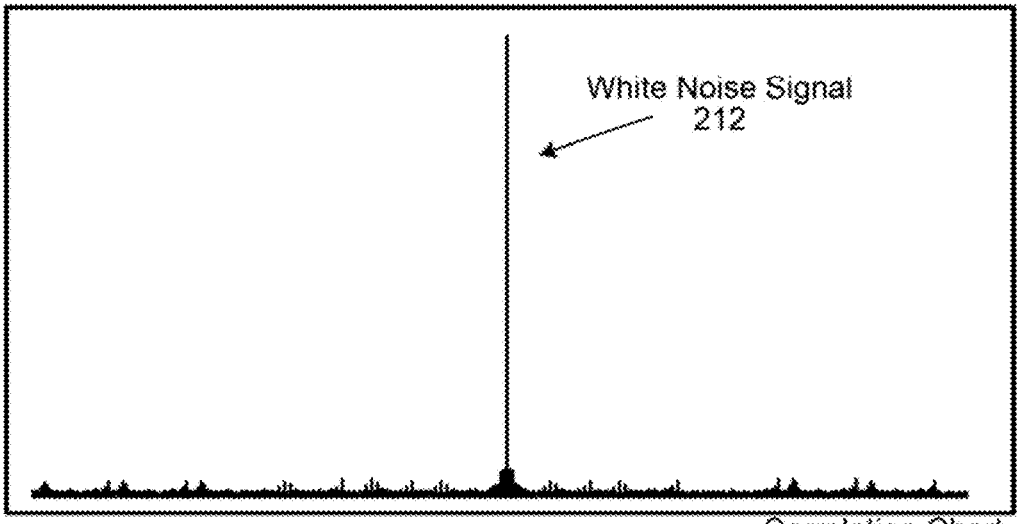
FIG. 2 illustrates examples of cross-correlation charts using different reference signals.
Figure 2:
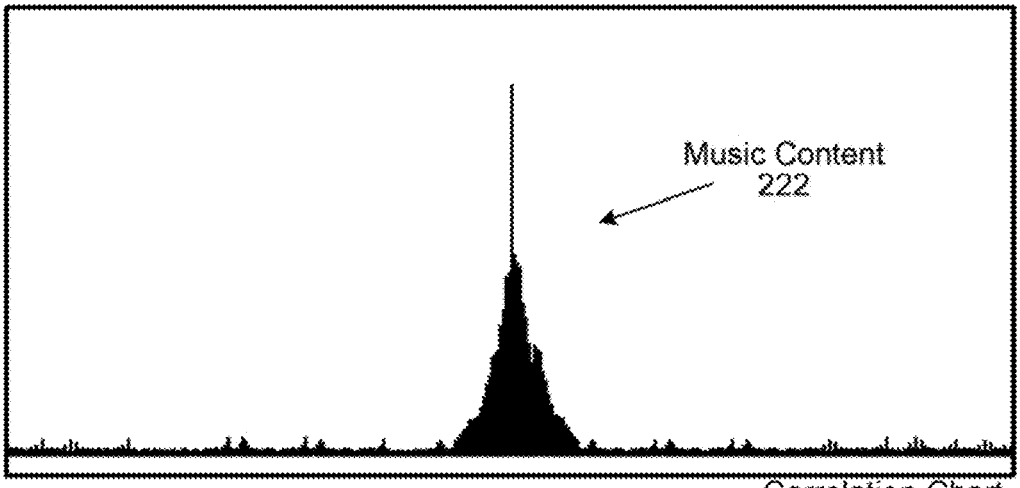
Figure 2:
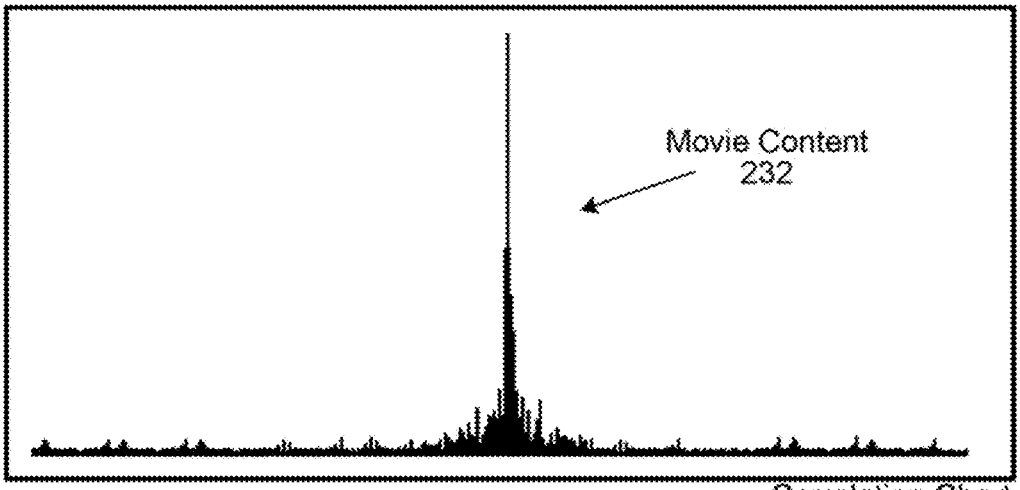

FIG. 2 illustrates examples of cross-correlation charts corresponding to different playback audio data. As illustrated in FIG. 2, a first correlation chart 210 represents cross-correlation data corresponding to a white noise signal 212 being sent as playback audio data to the loudspeaker 116. As white noise is random, cross-correlation using the white noise signal 212 results in a clearly defined peak in the first correlation chart 210.

A second correlation chart 220 represents cross-correlation data corresponding to music content 222 being sent as playback audio data to the loudspeaker(s) 116. As music may include repetitive noises (e.g., bass track, the beat, etc.), cross-correlation using the music content 222 may result in a poorly defined peak with a gradual slope.

A third correlation chart 230 represents cross-correlation data corresponding to movie content 232 being sent as playback audio data to the loudspeaker(s) 116. Sounds in a movie are typically unique and non-repetitive, so cross-correlation using the movie content 232 results in a more clearly defined peak than the music content 232, while not as clearly defined as the white noise signal 212.

As illustrated in FIG. 2, when the device 110 sends a control signal (e.g., pulse) or a white noise signal 212, the peak may be easily detected in the cross-correlation data and the device 110 may determine the echo latency estimate based on the peak. However, real-world situations involving music content 222 and movie content 232 are less clearly defined and therefore less easily detected in the cross-correlation data. In addition, different transmitters (e.g., loudspeakers) will have different latencies, depending on where they are located and how loud they are playing, a frequency response of the transmitter and/or other characteristics of the transmitter, so the device 110 has to accommodate all of these different scenarios and accurately detect the reference signal in the cross-correlation data.

Figure 3:
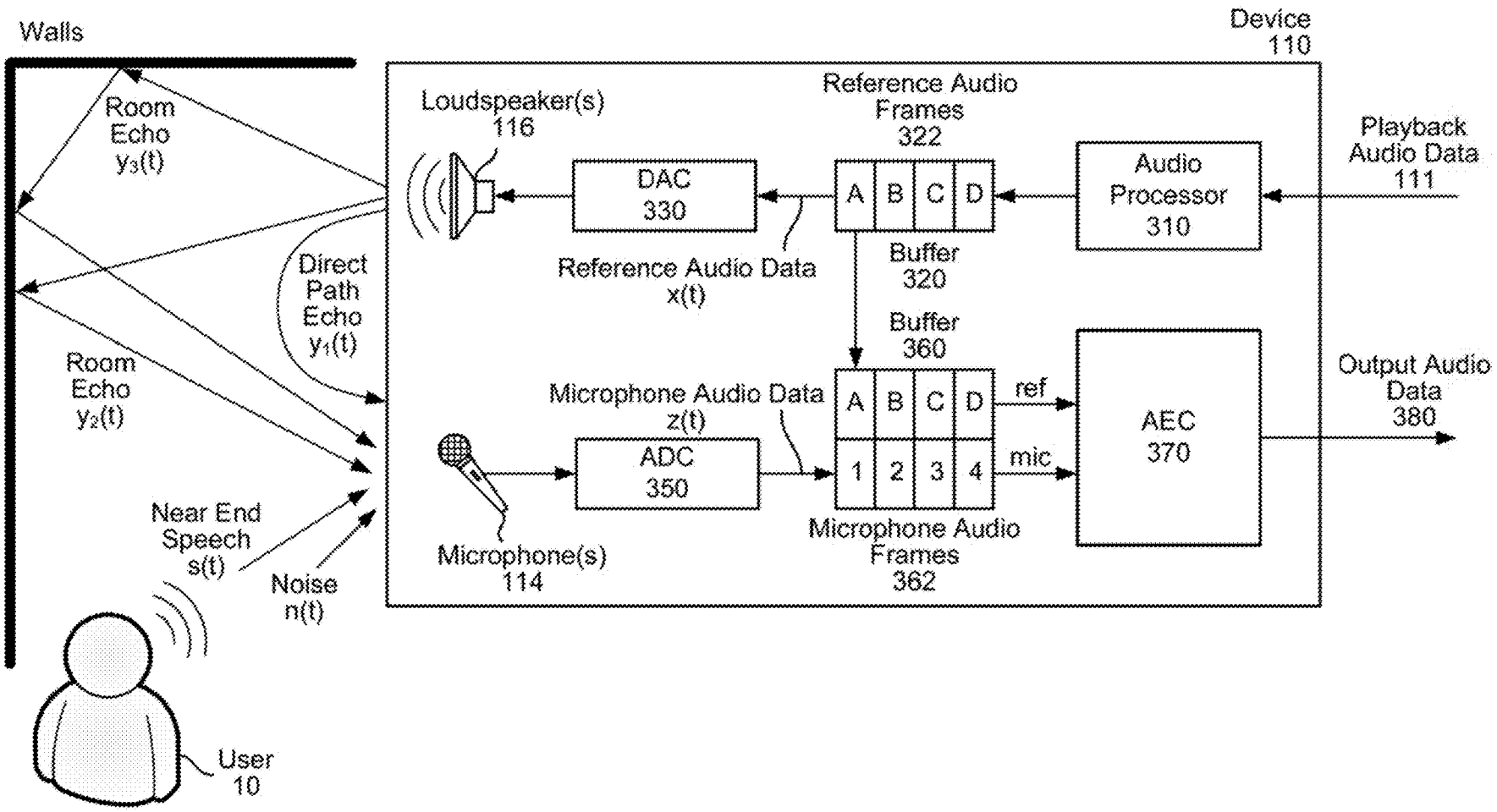
FIG. 3 illustrates an example of echo path delays and performing noise cancellation according to embodiments of the present disclosure.

FIG. 3 illustrates an example of echo path delays and performing noise cancellation according to embodiments of the present disclosure. As illustrated in FIG. 3, the device 110 may receive playback audio data 111 (e.g., from the server(s) 120) and may process the playback audio data 111 using an audio processor 310. The output of the audio processor 310 may be referred to as reference audio data x(t), which may include reference audio frames A-D, collectively referred to as reference audio frames 322. However, while FIG. 3 distinguishes between the playback audio data 111 and the reference audio data x(t), this is intended for illustrative purposes only and, as they are very similar, the playback audio data 111 may be referred to as reference audio data x(t) without departing from the disclosure.

The reference audio data (e.g., reference audio frames 322) may be stored in a buffer 320 prior to being sent to a digital to analog converter (DAC) 330, which may convert the reference audio data x(t) from a digital signal to an analog signal. The DAC 330 may output the analog reference audio data to loudspeaker(s) 116 to generate the playback audio 11 (e.g., audible sound). While not illustrated in FIG. 3, the loudspeaker(s) 116 and/or the device 110 may include an amplifier to amplify the analog reference audio data prior to generating the playback audio 11.

As illustrated in FIG. 3, some of the playback audio 11 output by the loudspeaker(s) 116 may be recaptured by the microphone(s) 114. A portion of the playback audio 11 captured by the microphone(s) 114 may be referred to as an "echo," and therefore a representation of at least the portion of the playback audio 11 may be referred to as an echo signal y(t). For example, FIG. 3 illustrates a direct path echo signal $y_1(t)$ (e.g., direct path from the loudspeaker(s) 116 to the microphone(s) 114), a first room echo signal $y_2(t)$ (e.g., first reflection that is reflected by a first wall), and a second room echo signal $y_3(t)$ (e.g., second reflection reflected by a second wall and the first wall). However, the disclosure is not limited thereto, and there may be additional echo signals corresponding to additional loudspeaker(s) 116 and/or reflections that are not illustrated in FIG. 3.

Using the microphone(s) 114 and an analog to digital converter (ADC) 350, the device 110 may capture input audio as microphone audio data z(t). In addition to the echo signals y(t) illustrated in FIG. 3, the microphone audio data z(t) may include a representation of speech from the user 10 (e.g., near end speech s(t), which may be referred to as first speech $s_1(t)$) a representation of second speech from a second user (e.g., second speech $s_2(t)$), and/or a representation of ambient noise in the environment around the device 110 (e.g., noise n(t)). Thus, the microphone audio data z(t) may be illustrated using the following equation:

$$z(t)=s_1(t))+s_2(t))+y(t)+n(t) \quad [1]$$

To isolate the first speech $s_1(t)$, the device 110 may attempt to remove the echo signals y(t) from the microphone audio data z(t). However, as the device 110 cannot determine the echo signal y(t) itself, the device 110 instead generates an echo estimate signal y'(t) that corresponds to the echo signal y(t). Thus, when the device 110 removes the echo estimate signal y'(t) from the microphone audio data z(t), the device 110 is removing at least a portion of the echo signal y(t).

The device 110 may generate the echo estimate signal y'(t) based on the reference audio data x(t). For example, the device 110 may apply transfer function(s) to the reference audio data x(t) to generate the echo estimate signal y'(t). In order to synchronize the echo estimate signal y'(t) and the microphone audio data z(t), the device 110 may associate the reference audio frames 322 with corresponding microphone audio frames 362 (e.g., microphone audio frames 1-4) from the microphone audio data. For ease of illustration, this is illustrated in FIG. 3 as the device 110 storing the reference audio frames 322 and the microphone audio frames 362 in a buffer 360. For example, the device 110 may store all of the reference audio frames 322 in both the buffer 320 and the buffer 360, with the buffer 320 being a small buffer used to temporarily store the reference audio frames 322 prior to being output by the loudspeaker(s) 116 whereas the buffer 360 is a larger buffer used to synchronize the reference audio frames 322 to the microphone audio frames 362. However, the disclosure is not limited thereto and the device 110 may store none of or only a portion of the reference audio frames 322 along with the microphone audio frames 362 in the buffer 360. For example, the device 110 may store all of the reference audio frames 322 in the buffer 320 and either not store any of the reference audio frames 322 in the buffer 360 or may only store a portion of the reference audio frames 322 (e.g., subsampled reference audio frames) in the buffer 360.

Using an acoustic echo canceller 370, the device 110 may remove the echo estimate signal y'(t) from the microphone audio data z(t) to generate output audio data 380 (e.g., which may be referred to as error signal m(t)), which roughly corresponds to the first speech $s_1(t)$. In some examples, the device 110 may also remove the second speech $s_2(t)$ and/or the noise n(t) from the microphone audio data z(t), although the disclosure is not limited thereto.

As used herein, "noise" may refer to any undesired audio data separate from the desired speech (e.g., first speech $s_1(t)$). Thus, noise may refer to the second speech $s_2(t)$, the playback audio 11 generated by the loudspeaker 116, ambient noise n(t) in the environment around the device 110, and/or other sources of audible sounds that may distract from the desired speech. Therefore, "noise cancellation" refers to a process of removing the undesired audio data to isolate the desired speech. This process is similar to acoustic echo cancellation and/or acoustic interference cancellation, and noise is intended to be broad enough to include echoes and interference. While FIG. 3 illustrates the device 110 performing noise cancellation using AEC processing, the disclosure is not limited thereto and the device 110 may perform noise cancellation using acoustic echo cancellation (AEC), acoustic interference cancellation (AIC), acoustic noise cancellation (ANC), adaptive acoustic interference cancellation, and/or the like without departing from the disclosure.

The device 110 may be configured to isolate the first speech $s_1(t)$ to enable the user 10 to control the device 110 using voice commands and/or to use the device 110 for a communication session with a remote device (not shown). In some examples, the device 110 may send at least a portion of the output audio data 380 to the remote device as part of a Voice over Internet Protocol (VoIP) communication session, although the disclosure is not limited thereto. For example, the device 110 may send the output audio data 380 to the remote device either directly or via the server(s) 120. However, the disclosure is not limited thereto and in some examples, the device 110 may send at least a portion of the output audio data 380 to the server(s) 120 in order for the server(s) 120 to determine a voice command. For example, the output audio data 380 may include a voice command to control the device 110 and the device 110 may send at least a portion of the output audio data 380 to the server(s) 120, which may determine the voice command represented in the microphone audio data z(t) and perform an action corresponding to the voice command (e.g., execute a command, send an instruction to the device 110 and/or other devices to execute the command, etc.). In some examples, to determine the voice command the server(s) 120 may perform Automatic Speech Recognition (ASR) processing, Natural Language Understanding (NLU) processing and/or command processing. The voice commands may control the device 110, audio devices (e.g., play music over loudspeakers, capture audio using microphones, or the like), multimedia devices (e.g., play videos using a display, such as a television, computer, tablet or the like), smart home devices (e.g., change temperature controls, turn on/off lights, lock/unlock doors, etc.) or the like without departing from the disclosure.

Figure 4A:
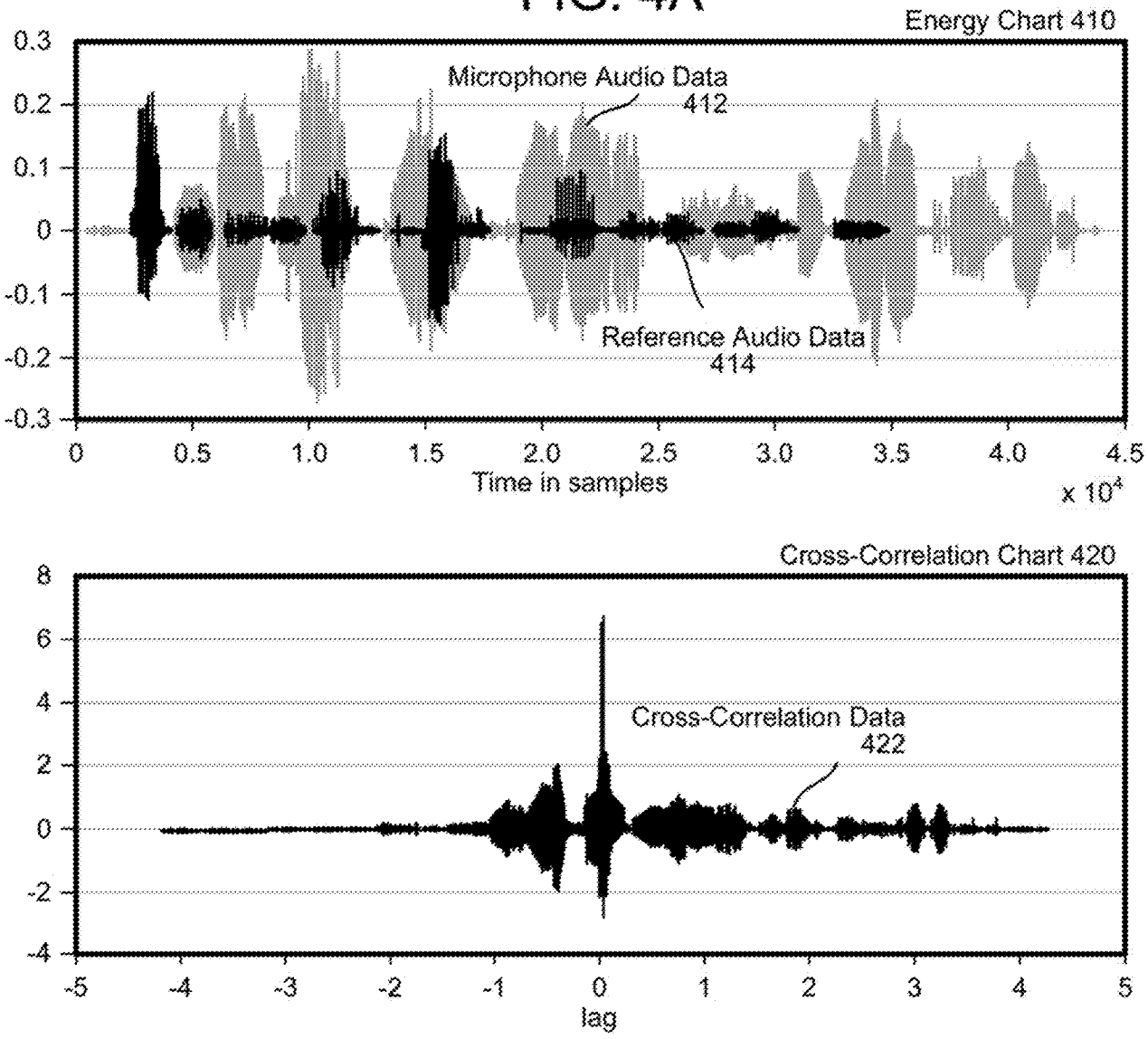
FIGS. 4A-4B illustrate examples of generating first cross-correlation data between reference data and microphone data and generating second cross-correlation data between sub sampled reference data and microphone data according to embodiments of the present disclosure.
Figure 4B:
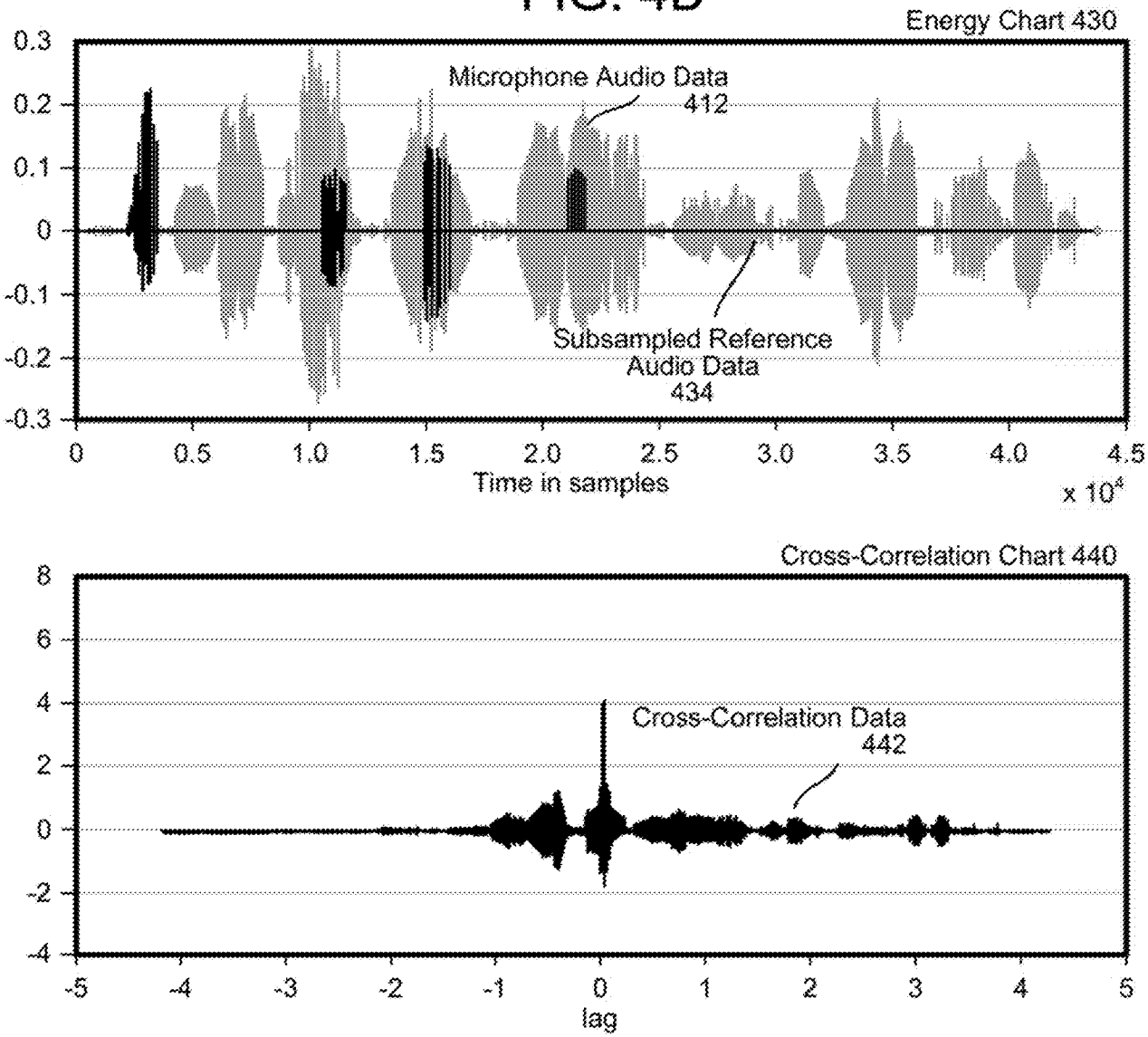

FIGS. 4A-4B illustrate examples of generating first cross-correlation data between reference data and microphone data and generating second cross-correlation data between sub sampled reference data and microphone data according to embodiments of the present disclosure. 4A illustrates an energy chart 410 including microphone audio data 412 and reference audio data 414. Taking a cross-correlation between the microphone audio data 412 and the reference audio data 414 generates cross-correlation data 422, illustrated in cross-correlation chart 420. The cross-correlation data 422 corresponds to normal processing using the full reference audio data 414.

In contrast, FIG. 4B illustrates an example of generating cross-correlation data using subsampled reference audio data. FIG. 4B illustrates an energy chart 430 that includes the microphone audio data 412 and subsampled reference audio data 434. As illustrated in FIG. 4B, the subsampled reference audio data 434 only includes portions of the reference audio data 414, specifically portions that correspond to strong peaks (e.g., positive or negative magnitude values that correspond to local maxima or local minima). Thus, the subsampled reference audio data 434 includes only a fraction of the reference audio samples included in the reference audio data 414. As discussed above, using the $95^{th}$ percentile results in the subsampled reference audio data 434 including 1/20 of the reference audio samples included in the reference audio data 414, using the $99^{th}$ percentile results in the subsampled reference audio data 434 including 1/100 of the reference audio samples included in the reference audio data 414, and so on.

Taking a cross-correlation between the microphone audio data 412 and the subsampled reference audio data 434 generates cross-correlation data 442, illustrated in cross-correlation chart 440. While the subsampled reference audio data 434 only includes a fraction of the reference samples included in the reference audio data 414, the cross-correlation data 442 mirrors the cross-correlation data 422 and can be used to determine the echo latency. For example, the cross-correlation data 442 exhibits the same waveform shape and timing as the cross-correlation data 422, albeit with lower peaks and/or magnitudes overall. Thus, despite the slight differences between the cross-correlation data 422 and the cross-correlation data 442 in terms of overall magnitude, they have identical time offsets and therefore they both result in the same estimates for the echo latency.

The device 110 may generate the subsampled reference audio data 434 by sampling the reference audio data 414 using a desired percentile, selecting individual reference audio samples that are at or higher than the desired percentile. To illustrate an example, if the desired percentile is $95^{th}$ percentile, then the device 110 may sample the reference audio data 414 such that the subsampled reference audio data 434 only includes reference audio samples in the $95^{th}$ percentile or higher, resulting in a 1/20 reduction in reference audio samples relative to the reference audio data 414. Similarly, if the desired percentile is $99^{th}$ percentile, then the device 110 may sample the reference audio data 414 such that the subsampled reference audio data 434 only includes reference audio samples in the $99^{th}$ percentile or higher, resulting in a 1/100 reduction in reference audio samples relative to the reference audio data 414.

Figure 5:
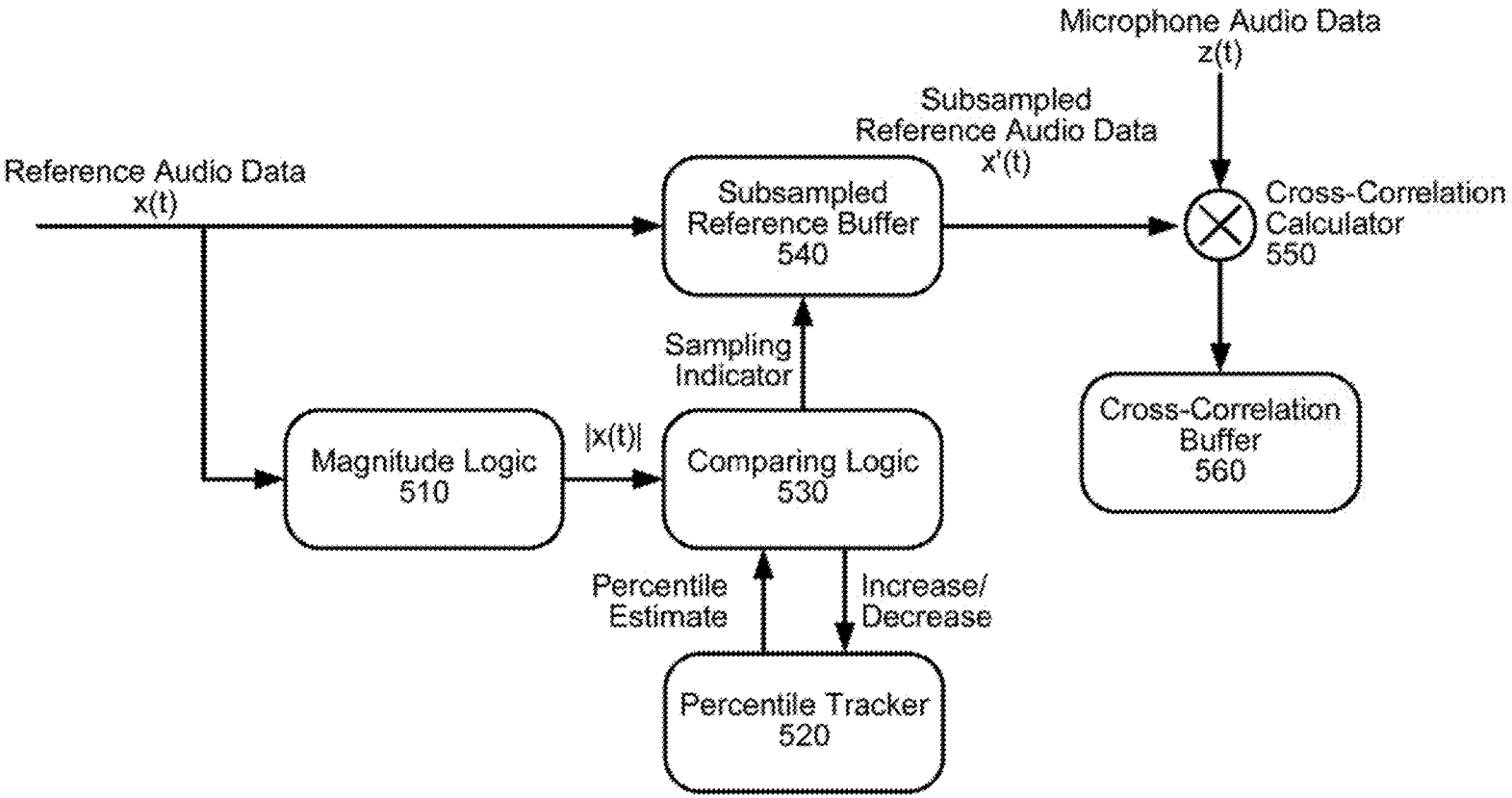
FIG. 5 illustrates an example component diagram for subsampling reference data using an estimated percentile value and generating cross-correlation data using the subsampled reference data according to embodiments of the present disclosure.

FIG. 5 illustrates an example component diagram for subsampling reference data using an estimated percentile value and generating cross-correlation data using the subsampled reference data according to embodiments of the present disclosure. As illustrated in FIG. 5, the device 110 may generate the subsampled reference audio data by comparing a magnitude of individual reference audio samples (e.g., absolute value, square of the magnitude, etc.) to the percentile estimate value and selecting only the individual reference audio samples having a magnitude that exceeds the percentile estimate value. For example, the subsampled reference audio data may only include first reference audio samples that have a magnitude in the $99^{th}$ percentile (whether positive or negative), while second reference audio samples having a magnitude below the percentile estimate value are discarded. In addition, the device 110 may update the percentile estimate value based on whether the individual reference audio sample exceeds the percentile estimate value. For example, the device 110 may decrease the percentile estimate value by a first amount when a reference audio sample is below the percentile estimate value (e.g., for each of the second reference audio samples), and increase the percentile estimate value by a second amount when the reference audio sample exceeds the percentile estimate value (e.g., for each of first reference audio samples).

As illustrated in FIG. 5, the device 110 may receive reference audio data x(t), which may be input to magnitude logic 510 to determine a magnitude for individual reference audio samples. For ease of illustration, the component(s) that calculate the magnitude are referred to as magnitude logic 510, although the magnitude logic 510 may include simple components that calculate the magnitude without any particular programming or complexity. Thus, the magnitude logic 510 may determine an amount of energy included in the reference audio sample using any techniques known to one of skill in the art, such that the device 110 may identify reference audio samples having a magnitude above a variable threshold value (e.g., selecting magnitudes above a variable threshold value corresponding to the $95^{th}$ percentile, the $99^{th}$ percentile, etc.) regardless of whether the magnitude is positive or negative. For example, the magnitude logic 510 may determine a magnitude of a first reference audio sample and calculate an absolute value of the magnitude, a square of the magnitude, and/or the like. FIG. 5 illustrates the output of the magnitude logic 510 as an absolute value of the reference audio data $|x(t)|$, although the disclosure is not limited thereto.

A percentile tracker 520 generates a percentile estimate value corresponding to the desired percentile during processing. Prior to processing the reference audio data, the percentile tracker 520 is initialized using an initial value that does not correspond to the desired percentile, but after processing the reference audio data x(t) for a period of time the percentile tracker 520 will converge on an accurate estimate of the desired percentile. After converging on the desired percentile, the percentile tracker 520 will track the desired percentile based on variations in the reference audio data x(t), such that the percentile estimate value will correspond to the desired percentile. Thus, the percentile estimate acts as a variable threshold value, varying over time based on magnitudes of the reference audio data x(t).

The output of the magnitude logic 510 and the percentile estimate value output by the percentile tracker 520 is input to comparing logic 530, which compares the absolute value of the reference audio data $|x(t)|$ to the percentile estimate value for individual reference audio samples. The comparing logic 530 only selects individual reference audio samples having a magnitude that exceeds the percentile estimate value, discarding the reference audio samples that do not exceed the percentile estimate value. For example, the comparing logic 530 may compare a first magnitude of a first reference audio sample to the percentile estimate value and, if the first magnitude is below the percentile estimate value, the comparing logic 530 may send a first sampling indicator value (e.g., 0) to a subsampled reference buffer 540 indicating that the reference audio sample should not be stored in the subsampled reference buffer 540. In contrast, if the first magnitude exceeds the percentile estimate value, the comparing logic 530 may send a second sampling indicator value (e.g., 1) to the subsampled reference buffer 540 indicating that the reference audio sample should be stored in the subsampled reference buffer 540.

While the above example indicated that the comparing logic 530 sends either the first sampling indicator value (e.g., 0) or the second sampling indicator value (e.g., 1), the disclosure is not limited thereto. Instead, the comparing logic 530 may only output a sampling indicator value when the first magnitude exceeds the percentile estimate value, such that the subsampled reference buffer 540 discards all reference audio samples received unless the subsampled reference buffer 540 receives the sampling indicator value from the comparing logic 530.

By selecting only the reference audio samples having a magnitude that exceeds the percentile estimate value, the subsampled reference buffer 540 generates subsampled reference audio data x'(t). For example, the subsampled reference audio data x'(t) may only include first reference audio samples that have a magnitude in the $99^{th}$ percentile (whether positive or negative), while second reference audio samples having a magnitude below the percentile estimate value are discarded. Note that while the comparing logic 530 uses the absolute value of the reference audio data |x(t)| to compare to the percentile estimate value, the subsampled reference buffer 540 stores original values of the reference audio samples that correspond to the reference audio data x(t).

In addition, the comparing logic 530 may send a signal to the percentile tracker 520 to update the percentile estimate value based on whether the individual reference audio sample exceeds the percentile estimate value. For example, the comparing logic 530 may send a first signal to decrease the percentile estimate value by a first amount when a reference audio sample is below the percentile estimate value (e.g., for each of the second reference audio samples), or may send a second signal to increase the percentile estimate value by a second amount when the reference audio sample exceeds the percentile estimate value (e.g., for each of first reference audio samples). An example of how the comparing logic 530 operates using different desired percentiles is illustrated in FIG. 6.

Figure 6:
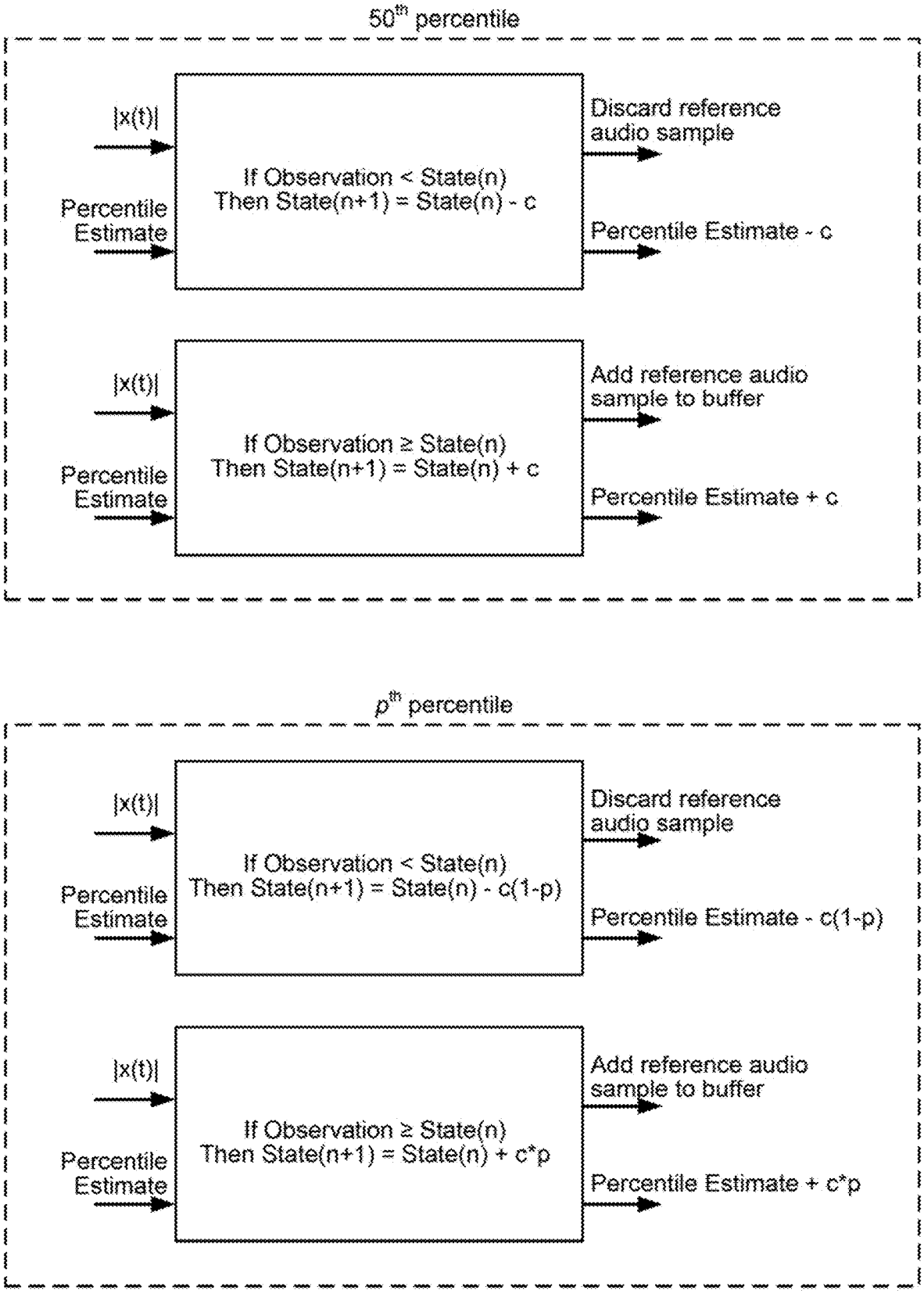
FIG. 6 illustrates examples of subsampling reference data using different percentiles according to embodiments of the present disclosure.

FIG. 6 illustrates examples of subsampling reference data using different percentiles according to embodiments of the present disclosure. As illustrated in FIG. 6, if the desired percentile is the $50^{th}$ percentile, the device 110 may compare the absolute value of the reference audio data |x(t)| for individual reference audio samples to a percentile estimate value that corresponds to the $50^{th}$ percentile of the absolute value of the reference audio data |x(t)|. When the absolute value (e.g., observation) is less than the percentile estimate value (e.g., state(n)), such as Observation<State(n), the device 110 may discard the reference audio sample (e.g., not include the reference audio sample in the subsampled audio data) and decrease a value of the percentile estimate by a fixed amount (e.g., State(n+1)=State(n)−c, where c is a constant value). In contrast, when the absolute value (e.g., observation) is greater than or equal to the percentile estimate value (e.g., state(n)), such as Observation≥State(n), the device 110 may sample the reference audio sample (e.g., include the reference audio sample in the subsampled audio data) and increase a value of the percentile estimate by the fixed amount (e.g., State(n+1)=State(n)+c, where c is a constant value).

The $50^{th}$ percentile corresponds to increasing or decreasing the percentile estimate value by the same amount (e.g., constant value c). However, using other desired percentiles results in decreasing the percentile estimate value by a first amount and increasing the percentile estimate value by a second amount, with the first amount and the second amount corresponding to the desired percentile.

As illustrated in FIG. 6, if the desired percentile is the $p^{th}$ percentile, the device 110 may compare the absolute value of the reference audio data |x(t)| for individual reference audio samples to a percentile estimate value that corresponds to the $p^{th}$ percentile of the absolute value of the reference audio data |x(t)|. When the absolute value (e.g., observation) is less than the percentile estimate value (e.g., state(n)), such as Observation<State(n), the device 110 may discard the reference audio sample (e.g., not include the reference audio sample in the subsampled audio data) and decrease a value of the percentile estimate by a first amount (e.g., State(n+1)=State(n)−c(1−p), where c is a constant value and p indicates the desired percentile as a value between 0 and 1). In contrast, when the absolute value (e.g., observation) is greater than or equal to the percentile estimate value (e.g., state(n)), such as Observation≥State(n), the device 110 may sample the reference audio sample (e.g., include the reference audio sample in the subsampled audio data) and increase a value of the percentile estimate by a second amount (e.g., State(n+1)=State(n)+c*p, where c is a constant value and p indicates the desired percentile as a value between 0 and 1). To illustrate an example using the $95^{th}$ percentile, the device 110 may decrease the percentile estimate value by the first amount (e.g., 0.05*c) and increase the percentile estimate value by the second amount (e.g., 0.95*c). Thus, for roughly every 20 reference audio samples, the device 110 may decrease the percentile estimate value by the first amount for 19 reference audio samples and increase the percentile estimate value by the second amount for 1 reference audio sample.

Figure 7:
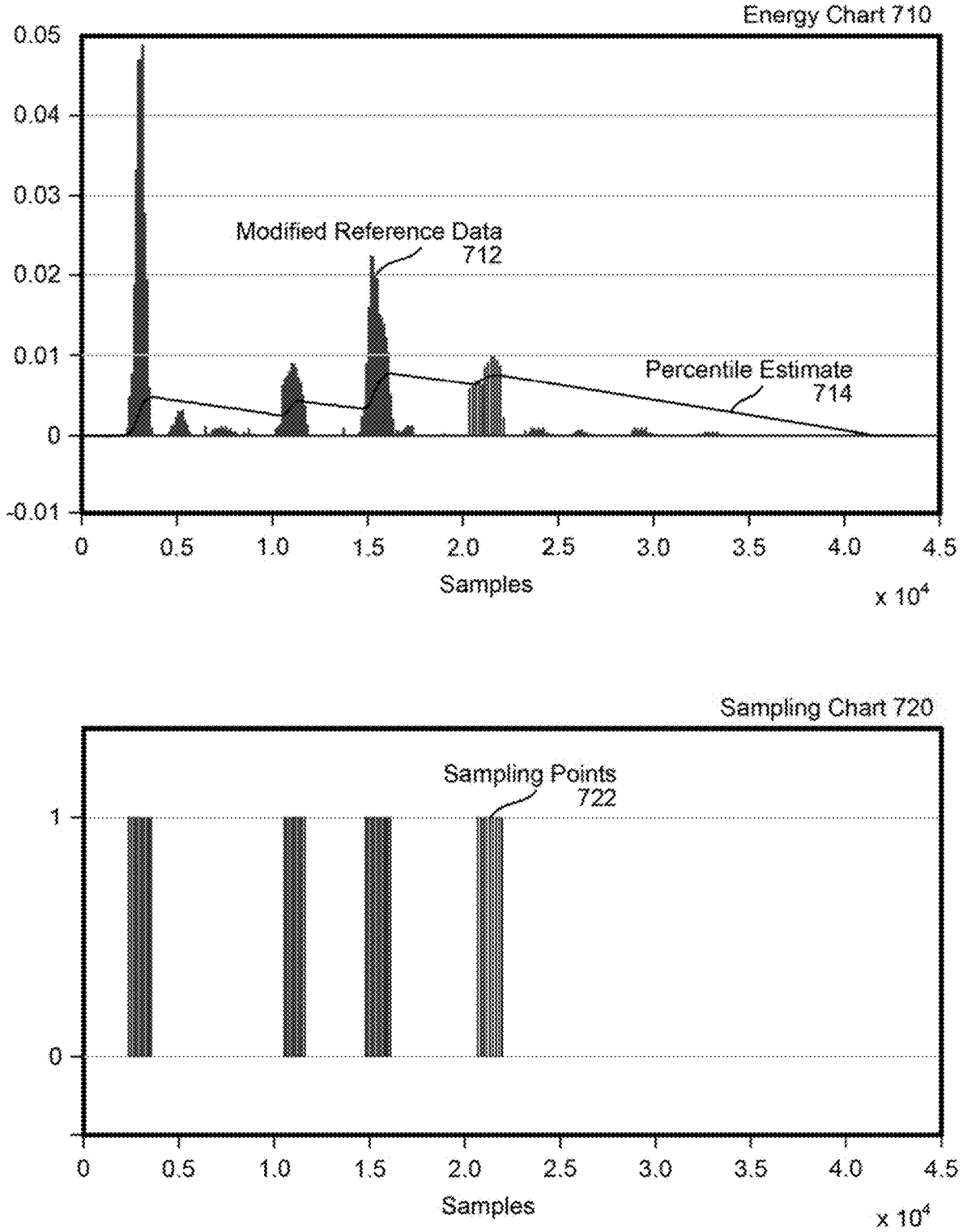
FIG. 7 illustrates an example of a percentile estimate and subsampled reference data according to embodiments of the present disclosure.

FIG. 7 illustrates an example of a percentile estimate and subsampled reference data according to embodiments of the present disclosure. As illustrated in FIG. 7, an energy chart 710 represents modified reference data 712 (e.g., absolute value of the reference audio data |x(t)| output by the magnitude logic 510) along with a percentile estimate 714. As illustrated by the energy chart 710, the percentile estimate 714 increases when the modified reference data 714 exceeds the percentile estimate 714 (e.g., peaks in the modified reference data 714), and decreases when the modified reference audio data 714 is below the percentile estimate 714. Thus, the percentile estimate 714 increases for short periods corresponding to a peak in the modified reference data 714 and slowly decreases until a following peak.

FIG. 7 illustrates a sampling chart 720, which indicates sampling points 722 corresponding to when the modified reference data 714 exceeds the percentile estimate 714 in energy chart 710. As illustrated in the sampling chart 720, the sampling points 722 have a first value (e.g., 1) for reference audio samples that exceed the percentile estimate 714 and have a second value (e.g., 0) for reference audio samples that are below the percentile estimate 714. The sampling points 722 may correspond to the sampling indicator signal sent from the comparing logic 530 to the subsampled reference buffer 540 to indicate which reference audio samples to include in the subsampled reference audio data x'(t).

Returning to FIG. 5, the subsampled reference audio data x'(t) may be output to a cross-correlation calculator 550, along with microphone audio data z(t). Thus, the cross-correlation calculator 550 may calculate cross-correlation data by determining a cross-correlation between the subsampled reference audio data x'(t) and the microphone audio data z(t), and the cross-correlation data may be stored in a cross-correlation buffer 560.

Figure 8:
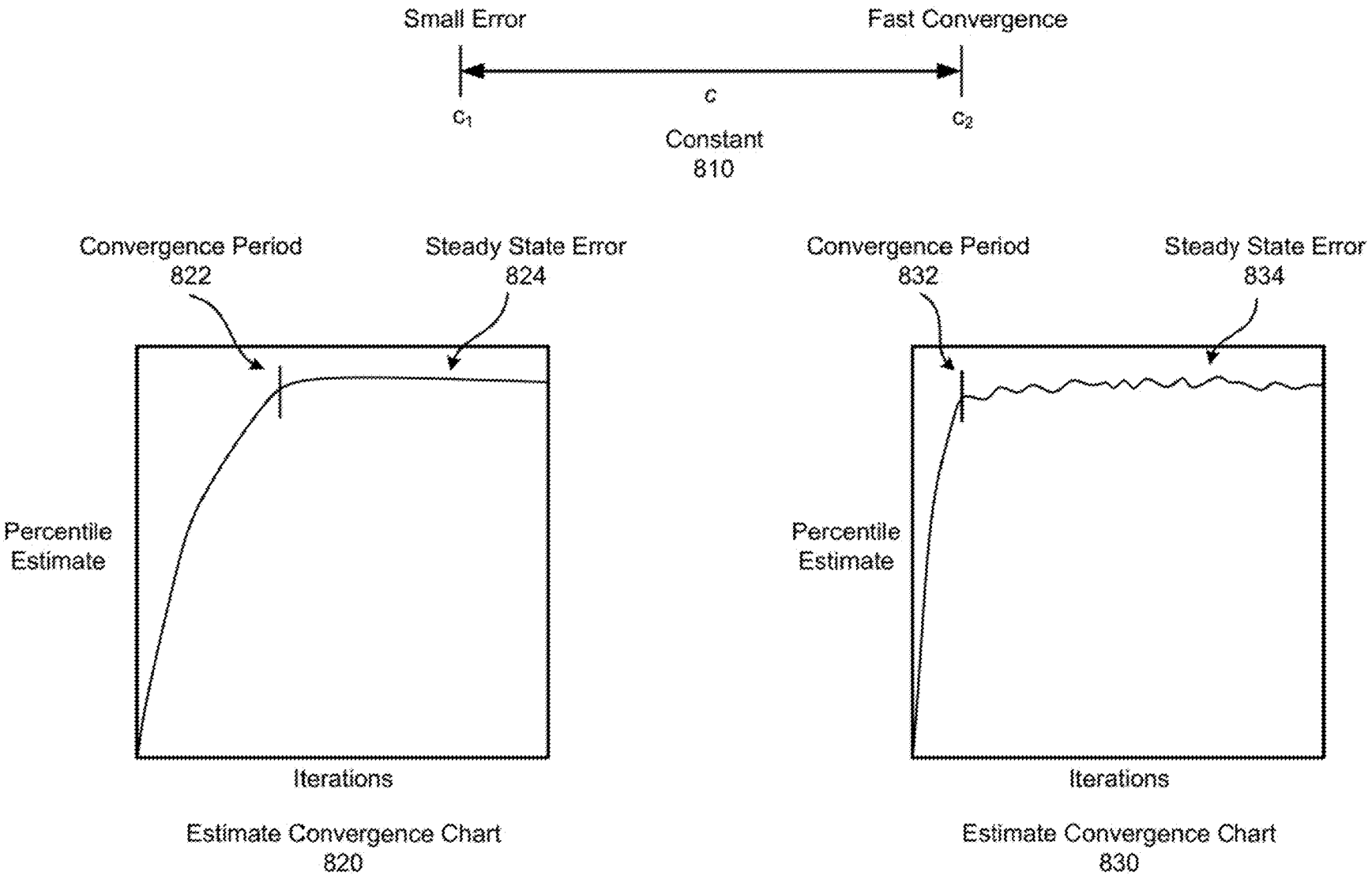
FIG. 8 illustrates examples of convergence periods and steady state error associated with different constant values according to embodiments of the present disclosure.

FIG. 8 illustrates examples of convergence periods and steady state error associated with different constant values according to embodiments of the present disclosure. As illustrated in FIG. 8, the value chosen as the constant value c (e.g., coefficient value or multiplier) may control an amount of time required for the device 110 to converge on an accurate percentile estimate value. For example, choosing a small value may improve results once the device 110 has converged on an accurate percentile estimate value, but may increase a period of time required to converge. In contrast, choosing a large value may reduce a period of time required to converge, but the percentile estimate may vary over time.

As illustrated in FIG. 8, a constant value c 810 may vary between a lower bound (e.g., $c_1$) and an upper bound (e.g., $c_2$). To illustrate the difference, FIG. 8 illustrates a first estimate convergence chart 820 using the lower bound $c_1$ and a second estimate convergence chart 830 using the upper bound $c_2$. As illustrated in the first estimate convergence chart 820, using a smaller constant value c (e.g., lower bound $c_1$) corresponds to a relatively long convergence period 822 (e.g., time until the percentile estimate value matches an actual percentile value) but relatively low steady state error 824 (e.g., the percentile estimate value accurately estimates the actual percentile value). In contrast, the second estimate convergence chart 830 illustrates that a relatively large constant value c (e.g., $c_2$) corresponds to a relatively short convergence period 832 and a relatively large steady state error 834. While the large constant value c quickly matches the percentile estimate value to the actual percentile value, the large constant value c prevents the percentile estimate value from accurately tracking the actual percentile value over time due to misadjustments caused by noise sensitivity and/or variations in the cross-correlation data.

The device 110 may select a constant value c based on common values in the cross-correlation data. For example, the device 110 may have a fixed value that is used to determine the percentile estimate value for any reference audio data. However, the disclosure is not limited thereto, and in some examples the device 110 may vary the constant value c without departing from the disclosure. For example, the device 110 may select a large constant value c when the device 110 is converging on the actual percentile value (e.g., to decrease a duration of the convergence period) and may select a small constant value c when the device 110 is in the steady state (e.g., to improve an accuracy of the percentile estimate).

Additionally or alternatively, in some examples the device 110 may vary the desired percentile in order to vary the sampling rate of the subsampled reference audio data. For example, if the echo signal is faint (e.g., weak correlation between the subsampled reference audio data and the microphone audio data), the device 110 may increase the sampling rate of the subsampled reference audio data by decreasing the desired percentile (e.g., selecting the $95^{th}$ percentile instead of the $99^{th}$ percentile, thus increasing the number of reference audio samples included in the subsampled reference audio data).

In some examples, the device 110 may determine whether the device 110 is operating in steady state conditions based on a number of reference audio samples that exceed the percentile estimate. Typically, the device 110 converges on an accurate percentile estimate during an initial convergence period and then tracks the percentile estimate accurately unless there are changes to the underlying signal (e.g., reference audio samples). An example of a change to the underlying signal is if an average value of the reference audio sample changes abruptly, which may be referred to as a level shift. Thus, the device 110 is typically operating during steady state conditions until an abrupt level shift, at which point a convergence period occurs as the device 110 converges on a new accurate percentile estimate and operates during steady state conditions again.

To detect whether the device 110 is operating during steady state conditions, the device 110 may compare the number of reference audio samples that exceed the percentile estimate to threshold values. For example, a low threshold value corresponds to when the average value of the reference audio samples decreases (e.g., downward level shift), resulting in few reference audio samples exceeding the percentile estimate. This corresponds to a very small number of reference audio samples being selected to be included in the subsampled reference audio data, which prevents the device 110 from determining an estimate of the echo latency. When the number of reference audio samples that exceed the percentile estimate is below the low threshold value, the device 110 may temporarily stop estimating the echo latency (e.g., as there are not enough reference audio samples included in the subsampled reference audio data for an accurate estimate), may increase a value of the constant value c to decrease an amount of time before the device 110 converges on an accurate percentile estimate (e.g., decrease a duration of time associated with the convergence period), may decrease the desired percentile (e.g., to decrease the duration of time associated with the convergence period, as the percentile estimate is decreased by a larger amount per sample), may change how the device 110 generates the subsampled reference audio data, and/or the like.

In contrast, a high threshold value corresponds to when the average value of the reference audio samples increases (e.g., upward level shift), resulting in a large percentage of reference audio samples exceeding the percentile estimate. This corresponds to a very large number of reference audio samples being selected to be included in the subsampled reference audio data, which negates the benefit of subsampling the reference audio data and may overflow a buffer associated with the subsampled reference audio samples. When the number of reference audio samples that exceed the percentile estimate is above the high threshold value, the device 110 may temporarily stop estimating the echo latency (e.g., as there too many reference audio samples included in the subsampled reference audio data, resulting in an increased processing requirement), may increase a value of the constant value c to decrease an amount of time before the device 110 converges on an accurate percentile estimate (e.g., decrease a duration of time associated with the convergence period), may increase the desired percentile (e.g., to decrease the duration of time associated with the convergence period, as the percentile estimate is increased by a larger amount per sample exceeding the percentile estimate value), may change how the device 110 generates the subsampled reference audio data, and/or the like.

For ease of illustration, the following description will provide examples of using thresholds to determine that the device 110 is operating during the convergence period and/or during steady state conditions. However, the disclosure is not limited thereto and the device 110 may determine that the device 110 is operating during the convergence period and/or during steady state conditions using any techniques known to one of skill in the art. Assuming that the desired percentile is the $99^{th}$ percentile, the subsampled reference audio data will include roughly 1 out of every 100 reference audio samples (e.g., 1%) from the reference audio data. The exact percentage of reference audio samples included in the subsampled reference audio data may vary over time, as the percentile estimate may accurately track gradual changes in the average value of the reference audio samples and/or reference audio samples included in the $99^{th}$ percentile may be clumped together (e.g., long stretches of reference audio samples below the $99^{th}$ percentile followed by a series of reference audio samples above the $99^{th}$ percentile), but the device 110 may determine that the device 110 is operating during a convergence period when the percentage varies drastically from 1%. For example, the device 110 may detect a convergence period when the percentage decreases below a low threshold value (e.g., 1 out of every 1000 reference audio samples or 0.1%, for example). Similarly, the device 110 may detect a convergence period when the percentage increases above a high threshold value (e.g., 30 out of every 100 reference audio samples or 30%, for example).

As discussed above, during the convergence period (e.g., during non-steady state conditions when the percentage decreases below the low threshold value and/or increases above the high threshold value), the device 110 may temporarily stop estimating the echo latency. When the percentage increases above the high threshold value, the device 110 may stop estimating the echo latency as the subsampled reference audio data includes a large percentage of the reference audio samples, negating the benefit of subsampling and increasing a processing requirement of estimating the echo latency. However, the estimate of the echo latency should still be accurate as there are enough reference audio samples included in the subsampled reference audio data to determine a strong correlation between the subsampled reference audio data and the microphone audio data. In contrast, when the percentage decreases below the low threshold value, the device 110 may stop estimating the echo latency as the subsampled reference audio data includes a very small percentage of the reference audio samples, meaning that there are not enough reference audio samples to accurately estimate the echo latency.

During the convergence period (e.g., during non-steady state conditions), the device 110 may also increase a value of the constant c to decrease an amount of time before the device 110 converges on an accurate percentile estimate (e.g., decrease a duration of time associated with the convergence period). For example, increasing the value of constant c increases a first amount (e.g., c(1−p), which is (0.01)*c for the $99^{th}$ percentile) subtracted from the percentile estimate when a reference audio sample is below the percentile estimate. This results in the percentile estimate decreasing more quickly when the percentage is below the low threshold value, decreasing an amount of time for the device 110 to accurately estimate the percentile estimate after a downward level shift. Similarly, increasing the value of constant c increases a second amount (e.g., c*p, which is (0.99)*c for the $99^{th}$ percentile) added to the percentile estimate when a reference audio sample is above the percentile estimate. This results in the percentile estimate increasing more quickly when the percentage is above the high threshold value, decreasing an amount of time for the device 110 to accurately estimate the percentile estimate after an upward level shift. Once the device 110 detects steady state conditions, the device 110 may decrease a value of c to improve an accurate of the percentile estimate.

In some examples, during the convergence period (e.g., during non-steady state conditions) the device 110 may vary the desired percentile to decrease an amount of time before the device 110 converges on an accurate percentile estimate (e.g., decrease a duration of time associated with the convergence period). For example, when the percentage is below the low threshold value, the device 110 may decrease the desired percentile, as this increases the first amount (e.g., c(1−p), which is (0.01)*c for the $99^{th}$ percentile) subtracted from the percentile estimate when a reference audio sample is below the percentile estimate. To illustrate an example, lowering the desired percentile from the $99^{th}$ percentile (e.g., first amount equal to (0.01)*c) to the $95^{th}$ percentile (e.g., first amount equal to (0.05)*c) results in decreasing the percentile estimate five times faster. Alternatively, lowering the desired percentile from the $99^{th}$ percentile (e.g., first amount equal to (0.01)*c) to the $75^{th}$ percentile (e.g., first amount equal to (0.25)*c) results in decreasing the percentile estimate 25 times faster.

Similarly, when the percentage is above the high threshold value, the device 110 may increase the desired percentile, as this increases the second amount (e.g., c*p, which is (0.99)*c for the $99^{th}$ percentile) added to the percentile estimate when a reference audio sample exceeds the percentile estimate. However, this is less effective than varying the constant c and is much less noticeable than decreasing the desired percentile when the percentage is below the low threshold value, as the second amount increases only slightly. For example, raising the desired percentile from the $75^{th}$ percentile (e.g., second amount equal to (0.75)*c) to the $99^{th}$ percentile (e.g., second amount equal to (0.99)*c) only results in increasing the percentile estimate by 32% (e.g., slightly faster, but not 25 times faster). More importantly, the effect is negligible when the desired percentile starts at the $99^{th}$ percentile, as raising the desired percentile from the $99^{th}$ percentile (e.g., second amount equal to (0.99)*c) to the $99.99^{th}$ percentile (e.g., second amount equal to (0.9999)*c) only results in increasing the percentile estimate by 1%.

In some examples, during the convergence period (e.g., during non-steady state conditions), the device 110 may change how the device 110 generates the subsampled reference data. For example, instead of sampling reference audio samples that exceed the percentile estimate, the device 110 may sample the reference audio samples based on a fixed rate or the like, such as by selecting 1 out of every 100 reference audio samples without regard to the percentile estimate. To illustrate an example, when the percentage is below the low threshold value, the device 110 is selecting a very low percentage of samples (e.g., less than 1 out of every 1000 reference audio samples). Instead, the device 110 may select 1 out of every 100 reference audio samples, even though the selected reference audio samples do not exceed the percentile estimate. This increases the number of reference audio samples included in the subsampled reference audio data, enabling the device 110 to potentially determine a correlation between the subsampled reference audio data and the microphone audio data and therefore estimate the echo latency.

Similarly, when the percentage is above the high threshold value, the device 110 is selecting a large percentage of samples (e.g., more than 30 out of every 100 reference audio samples), which negates any benefits of subsampling the reference audio data. Instead, the device 110 may select 1 out of every 100 reference audio samples, even though some of the reference audio samples that are not selected exceed the percentile estimate. This decreases the number of reference audio samples included in the subsampled reference audio data, enabling the device 110 to reduce a processing required to determine the correlation between the subsampled reference audio data and the microphone audio data.

Additionally or alternatively, the device 110 may select each of the reference audio samples that exceeds the percentile estimate until a fixed number of reference audio samples are selected for an individual frame of reference audio data, at which point the device 110 discards all subsequent reference audio samples until the next frame of reference audio data. This fixed number of reference audio samples may be referred to as a safety margin s. For example, if the safety margin s corresponds to a fixed number of samples, the device 110 may select reference audio samples that exceed the percentile estimate until the device 110 has selected s reference audio samples for an individual frame of the reference audio data. This enables the device 110 to limit a maximum number of reference audio samples included in the subsampled reference audio data, which enables the device 110 to determine a correlation between the subsampled reference audio data and the microphone audio data for each frame of reference audio data without overflowing a buffer and/or exceeding a maximum processing consumption. In some examples, the device 110 may select the safety margin s based on a size of a buffer used to generate the subsampled reference audio data. For example, the device 110 may select the safety margin s to be lower than a maximum capacity of the buffer.

A size of the buffer may be determined based on a sampling rate of the reference audio data (e.g., a number of reference audio samples received per second), a desired percentile, and/or the like. For example, if the sampling rate of the reference audio data is 44.1 kHz (e.g., 44,100 samples per second) and the desired percentile is the $99^{th}$ percentile, the subsampled reference audio data may have a sampling rate of 441 Hz (e.g., 441 samples per second) during steady state conditions. Therefore, the buffer should be large enough to include at least 441 samples, although a larger size is beneficial. For example, the system 100 should allow additional headroom by sizing the buffer twice as large as the intended sampling rate (e.g., 1,000+ samples), by determining the intended sampling rate using a lower desired percentile, a combination thereof, and/or the like. For example, sizing the buffer using the $95^{th}$ percentile as the desired percentile results in a sampling rate of 2205 Hz (e.g., 2205 samples per second), and providing headroom (e.g., doubling the buffer size) results in the buffer being large enough to include 4410 samples or more. In this example, the safety margin s may be selected to be lower than 4400, meaning that a maximum number of reference audio samples included in the subsampled reference audio data per second is 4400, which corresponds to 10% of the reference audio data (e.g., 4400 reference audio samples per second selected out of 44,100 samples per second included in the reference audio data). Additionally or alternatively, the buffer may be configured to not roll over so that reference audio samples are not replaced if buffer overflow occurs.

Figure 9:
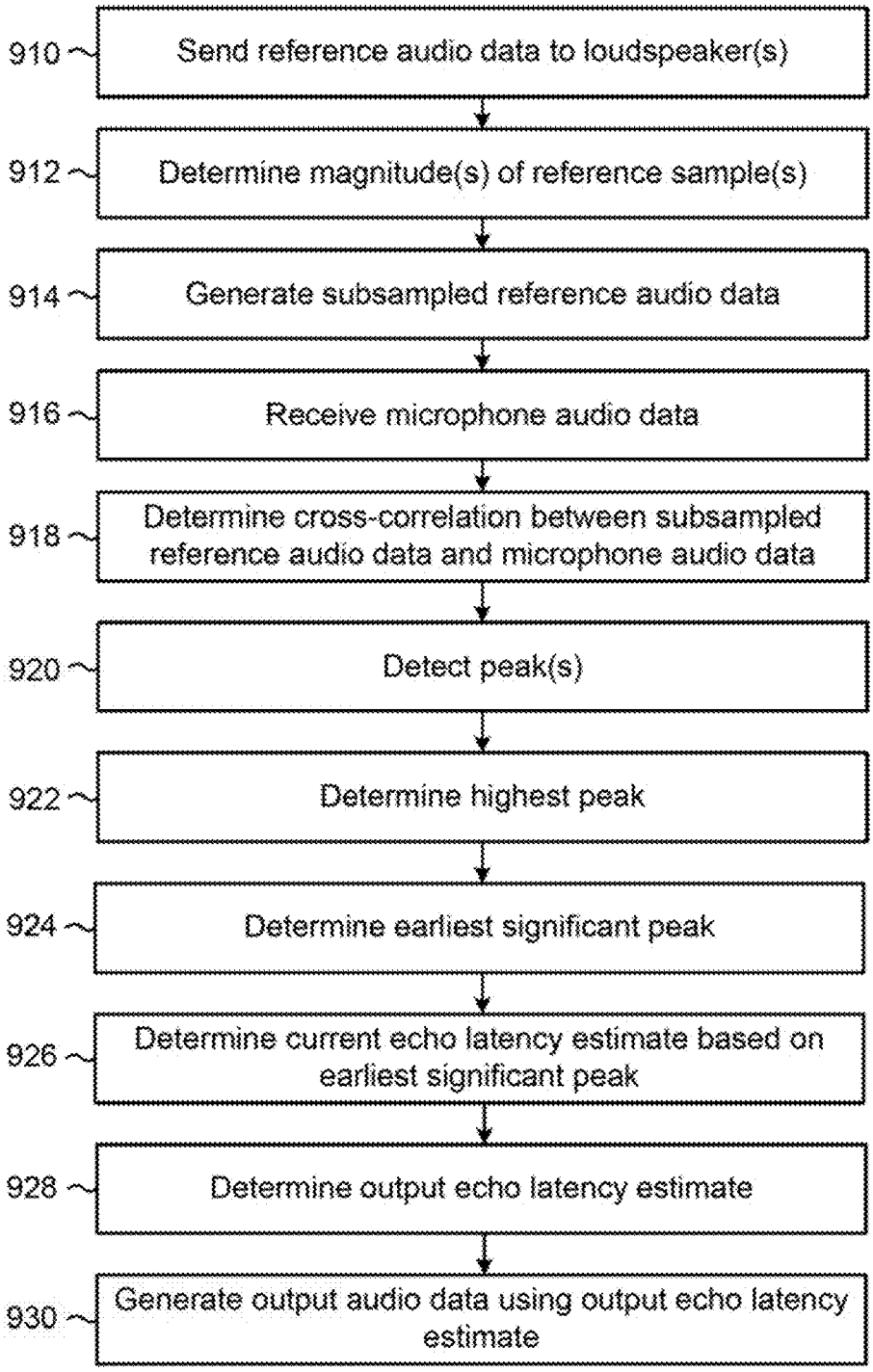
FIG. 9 is a flowchart conceptually illustrating an example method for determining an echo latency estimate according to embodiments of the present disclosure.

FIG. 9 is a flowchart conceptually illustrating an example method for determining an echo latency estimate according to embodiments of the present disclosure. As illustrated in FIG. 9, the device 110 may send (910) reference audio data to loudspeaker(s) 116 (or other output devices, such as transmitters, etc.) to generate an output (e.g., playback audio 11).

The device 110 may determine (912) magnitude(s) of the reference audio samples included in the reference audio data and may generate (914) subsampled reference audio data based on the magnitude(s). For example, the device 110 may subsample the reference audio data using a desired percentile, selecting individual reference audio samples that are at or higher than the desired percentile. To illustrate an example, if the desired percentile is $95^{th}$ percentile, then the device 110 may subsample the reference audio data such that the subsampled reference audio data only includes reference audio samples in the $95^{th}$ percentile or higher, resulting in a 1/20 reduction in reference audio samples relative to the reference audio data. Similarly, if the desired percentile is $99^{th}$ percentile, then the device 110 may subsample the reference audio data such that the subsampled reference audio data only includes reference audio samples in the $99^{th}$ percentile or higher, resulting in a 1/100 reduction in reference samples relative to the reference audio data.

As will be described in greater detail below with regard to FIG. 10A, the device 110 may generate the subsampled reference audio data by comparing a magnitude of individual reference audio samples (e.g., absolute value, square of the magnitude, etc.) to a percentile estimate value and selecting only the individual reference audio samples having a magnitude that exceeds the percentile estimate value. For example, the subsampled reference audio data may only include first reference audio samples that have a magnitude in the $99^{th}$ percentile (whether positive or negative), while second reference audio samples having a magnitude below the percentile estimate value are discarded. In addition, the device 110 may update the percentile estimate value based on whether the individual reference audio sample exceeds the percentile estimate value. For example, the device 110 may decrease the percentile estimate value by a first amount when a reference audio sample is below the percentile estimate value (e.g., for each of the second reference audio samples), and increase the percentile estimate value by a second amount when the reference audio sample exceeds the percentile estimate value (e.g., for each of first reference audio samples).

The device 110 may receive (916) input data, such as microphone audio data generated by microphone(s). The device 110 may determine (918) cross-correlation data corresponding to a cross-correlation between the subsampled reference audio data and the microphone audio data. The device 110 may detect (920) one or more peaks in the cross-correlation data, may determine (922) a highest peak of the one or more peaks, and may determine (924) an earliest significant peak in the cross-correlation data. For example, the device 110 may use the highest peak to determine a threshold value and may compare peaks earlier than the highest peak to the threshold value to determine if they are significant, as described in greater detail below with regard to FIG. 11.

The device 110 may then determine (926) a current echo latency estimate based on the earliest significant peak, and may determine (928) an output echo latency estimate. For example, the device 110 may determine the current echo latency estimate based on coordinates of the earliest significant peak along an x-axis. In some examples, the current echo latency estimate may be used as the output echo latency estimate. However, the disclosure is not limited thereto, and the device 110 may determine an output echo latency estimate using the current echo latency estimate along with previous echo latency estimates. For example, the device 110 may combine multiple estimates, including the current echo latency estimate, using a moving average, a weighted average or any techniques known to one of skill in the art without departing from the disclosure. This may improve the accuracy of the echo latency estimate and/or improve performance of the device 110 by smoothing out variations in the instantaneous estimates.

While FIG. 9 illustrates the device 110 determining an estimate for the echo latency based on an earliest significant peak represented in the cross-correlation data, the disclosure is not limited thereto. Instead, the device 110 may determine the echo latency estimate using other techniques known to one of skill in the art, such as a center of gravity of the cross-correlation data or the like.

The current echo latency estimate determined in step 926 may be referred to as an instantaneous estimate and the device 110 may determine instantaneous estimates periodically over time. In some examples, the device 110 may use the current echo latency estimate without performing any additional calculations. However, variations in the instantaneous estimates may reduce an accuracy and/or consistency of the echo latency estimate used by the device 110, resulting in degraded performance and/or distortion. To improve an accuracy of the echo latency estimate, in some examples the device 110 may generate a more stable echo latency estimate using a plurality of instantaneous estimates in a two-stage process. For example, the device 110 may first compute the instantaneous estimates per cross-correlation as a first stage. Then, as a second stage, the device 110 may track the instantaneous estimates over time to provide a final reliable estimate. For example, the device 110 may determine an average of the instantaneous estimates over time using techniques known to one of skill in the art.

By accurately determining the echo latency estimate, the system 100 may correct for echo latency and/or improve speech processing associated with an utterance by performing acoustic echo cancellation (AEC). For example, the system 100 may use the echo latency estimate to calculate parameters for AEC, such as a step size control parameter/value, a tail length value, a reference delay value, and/or additional information that improves performance of the AEC. Additionally or alternatively, the system 100 may perform the steps described above using non-audio signals to determine an echo latency estimate associated with other transmission techniques, such as RADAR, SONAR, or the like without departing from the disclosure.

Figure 10A:
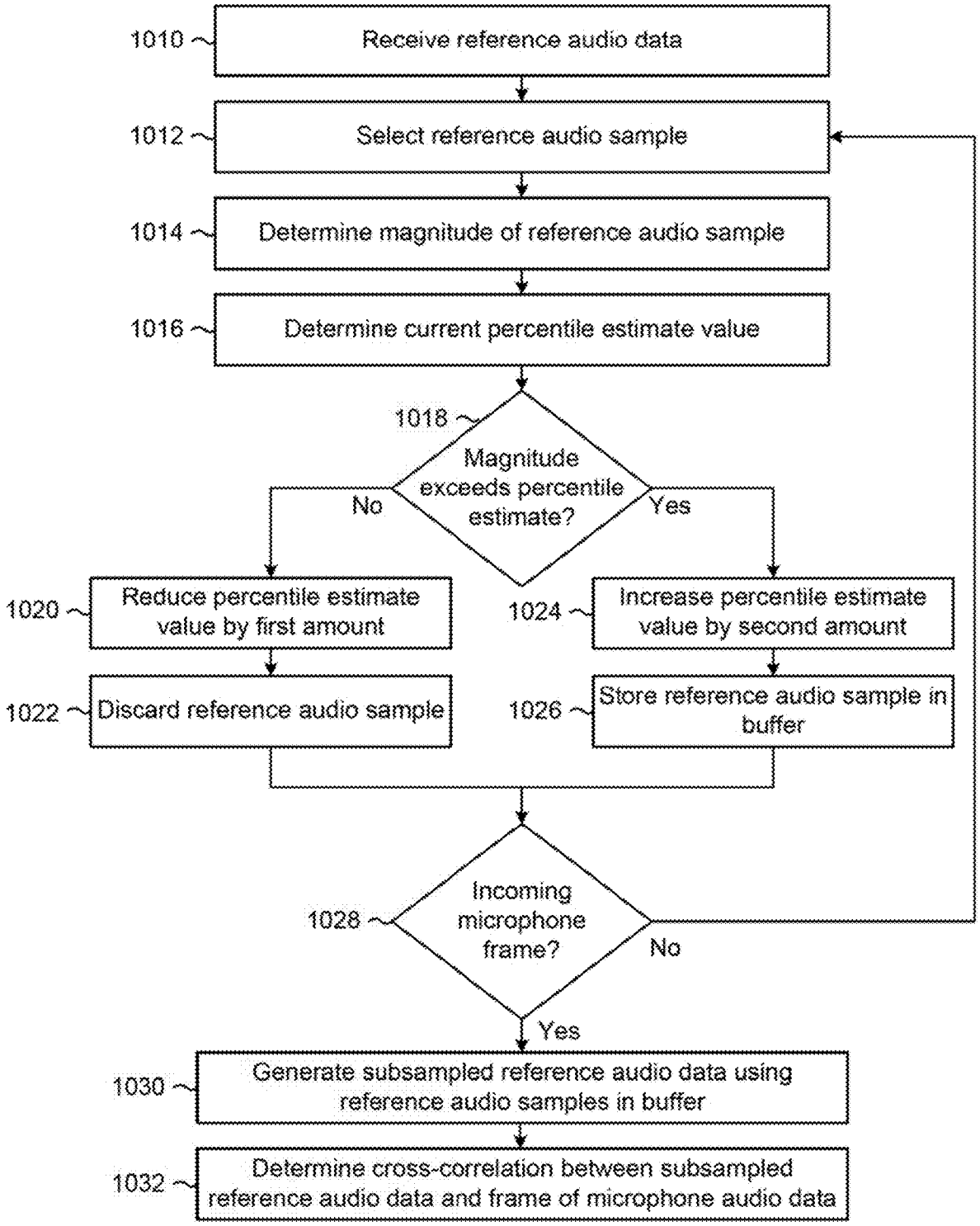
FIGS. 10A-10C are flowcharts conceptually illustrating example methods for determining cross-correlation data and estimating an echo latency estimate value according to embodiments of the present disclosure.
Figure 10B:
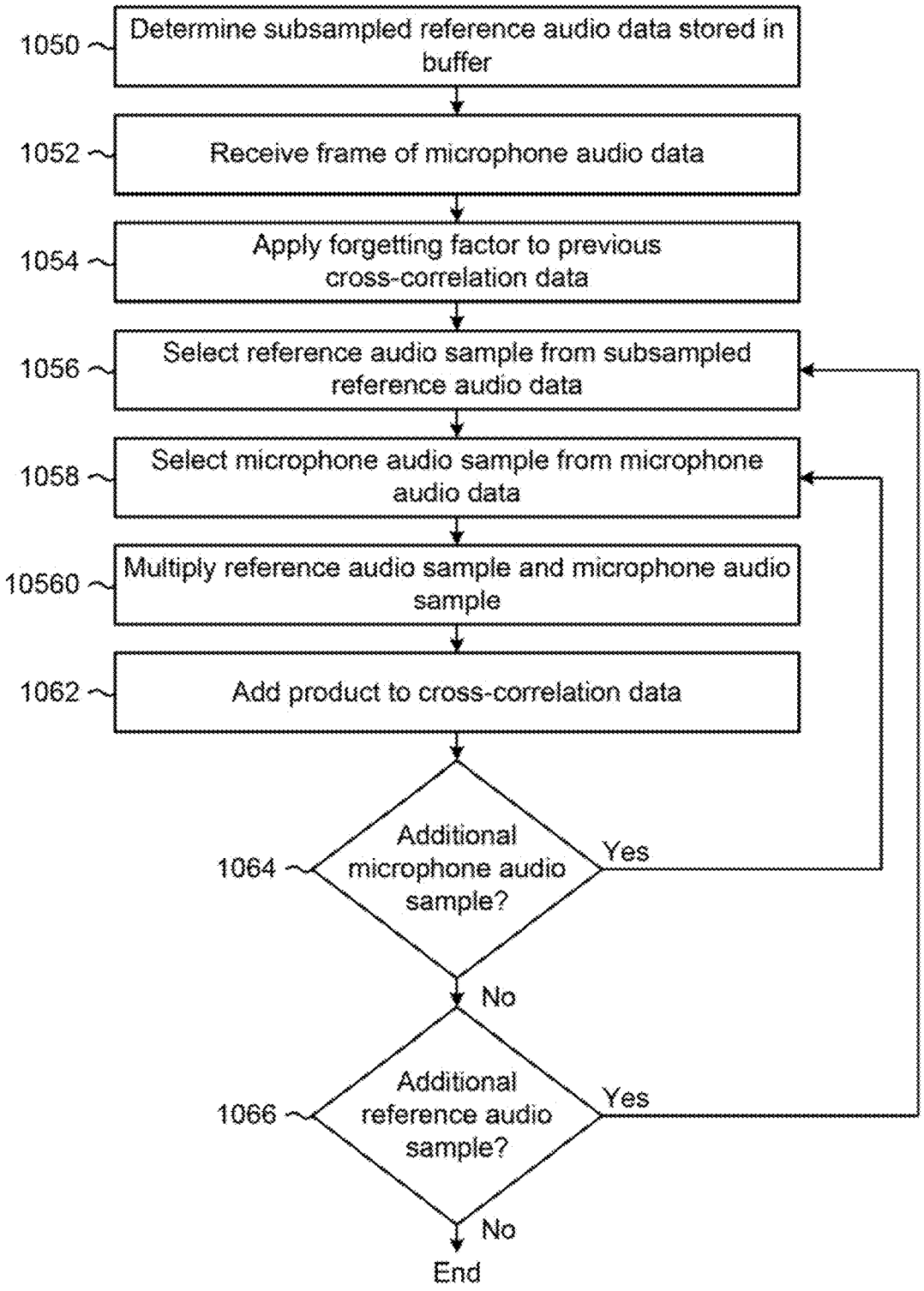
Figure 10C:
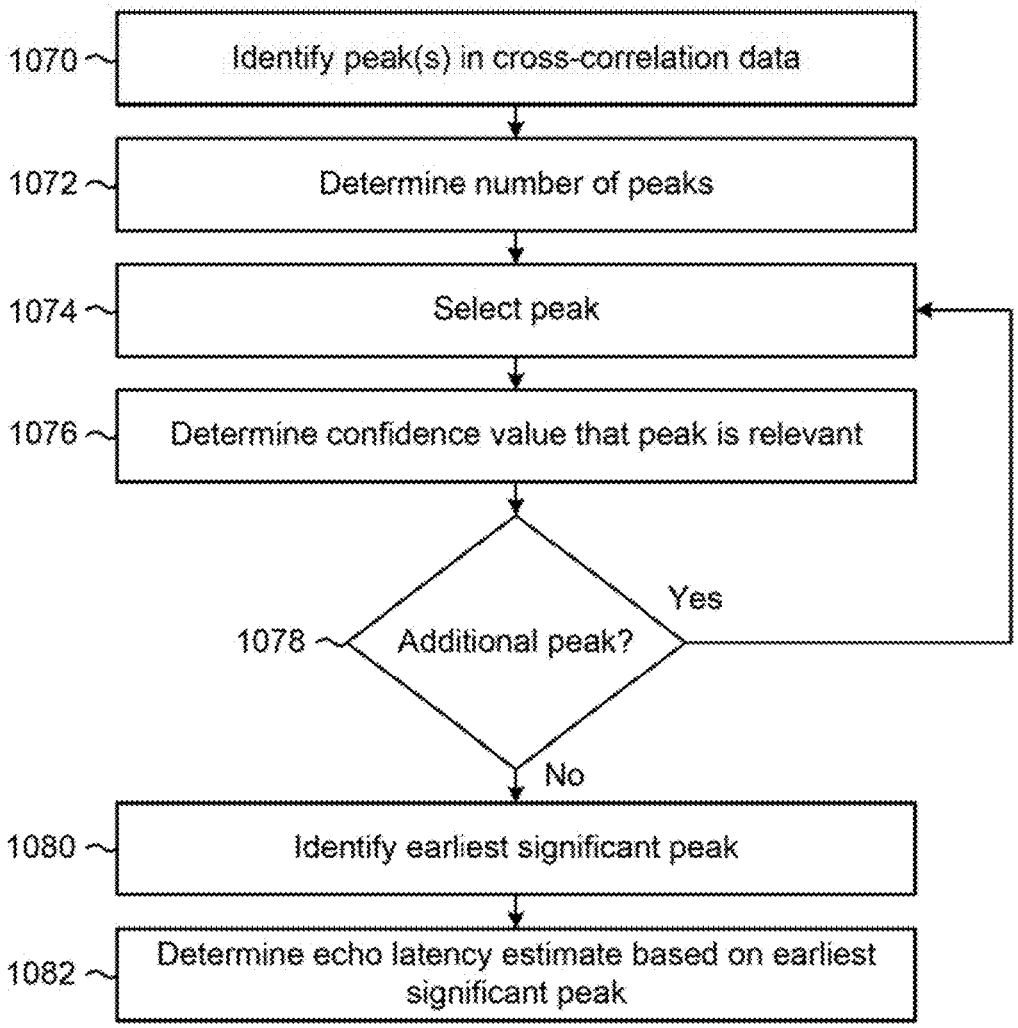

FIGS. 10A-10C are flowcharts conceptually illustrating example methods for determining cross-correlation data and estimating an echo latency estimate value according to embodiments of the present disclosure. As illustrated in FIG. 10A, the device 110 may receive (1010) reference audio data, may select (1012) a reference audio sample, and may determine (1014) a magnitude of the reference audio sample (e.g., absolute value, square of the magnitude, etc.). The device 110 may determine (1016) a current percentile estimate value corresponding to a desired percentile and may determine (1018) whether a magnitude of the reference audio sample exceeds the percentile estimate value.

If the magnitude exceeds the percentile estimate value in step 1018, the device 110 may reduce (1020) the percentile estimate value by a first amount and may discard (1022) the reference audio sample (e.g., not include the reference audio sample in subsampled reference audio data). If the magnitude exceeds the percentile estimate value in step 1018, the device 110 may increase (1024) the percentile estimate value by a second amount and may store (1026) the reference audio sample in a buffer associated with the subsampled reference audio data. Details of how the device 110 calculates the first amount and the second amount are described above with regard to FIG. 7.

The device 110 may determine (1028) whether there is an incoming microphone frame (e.g., frame of microphone audio data) and, if not, may loop to step 1012 and select another reference audio sample. If there is an incoming microphone frame, the device 110 may generate (1030) the subsampled reference audio data using the reference audio samples stored in the buffer and may determine (1032) cross-correlation data between the subsampled reference audio data and the frame of microphone audio data, as described in greater detail below with regard to FIG. 10B.

As illustrated in FIG. 10B, the device 110 may determine (1050) subsampled reference audio data stored in the buffer and may receive (1052) a frame of microphone audio data. After receiving the frame of the microphone audio data, the device 110 may apply (1054) a forgetting factor to previous cross-correlation data. For example, the device 110 may multiply each sample (e.g., lag) of the previous cross-correlation data by the forgetting factor, which is a value less than one, to discount old samples (e.g., "forget" previous cross-correlation data). The forgetting factor may correspond to a time constant, such that the forgetting factor may be selected to implement a particular time constant (e.g., discount old samples based on the time constant). In some examples, the forgetting factor may be a value between 0.98 and 1.

The device 110 may select (1056) a reference audio sample from the subsampled reference audio data and may select (1058) a microphone audio sample from the microphone audio data. The device 110 may multiply (1060) the reference audio sample and the microphone audio sample and add (1062) the product to the cross-correlation data. Thus, the device 110 may determine the cross-correlation data by determining a contribution of incoming samples in the microphone audio data and reference audio samples stored in a buffer, instead of recalculating the cross-correlation data each time. This reduces an amount of processing required, as instead of multiplying each reference audio sample included in the subsampled reference audio data by each microphone audio sample included in the microphone audio data (e.g., multiple frames of the microphone audio data), the device 110 may only multiple the reference audio samples included in the buffer by an incoming frame of microphone audio data (e.g., single frame of microphone audio data). However, the disclosure is not limited thereto and the device 110 may determine the correlation using other techniques known to one of skill in the art without departing from the disclosure.

The device 110 may determine (1064) whether there is an additional microphone audio sample in the frame of microphone audio data, and if so, may loop to step 1058 to select the additional microphone audio sample and repeat steps 1058-1062. If the device 110 determines that there is not an additional microphone audio sample, the device 110 may determine (1066) whether there is an additional reference audio sample and, if so, may loop to step 1056 to select the additional reference audio sample and repeat steps 1056-1064 for the additional reference audio sample. If there is not an additional reference audio sample, the processing may end and the device 110 may generate the cross-correlation data. Thus, the device 110 may multiply each reference audio sample included in the subsampled reference audio data by each microphone audio sample included in the frame of microphone audio data.

As illustrated in FIG. 10C, the device 110 may identify (1070) one or more peak(s) in the cross-correlation data, determine (1072) a number of the one or more peaks, select (1074) a first peak and determine (1076) a confidence value indicating whether the peak is relevant. For example, a first magnitude associated with the first peak may be compared to an average magnitude to determine a ratio between the first magnitude and the average magnitude (e.g., peak over average ratio). Thus, a high ratio may correspond to a high confidence value (e.g., first peak is clearly separated from the cross-correlation data), whereas a low ratio may correspond to a low confidence value (e.g., first peak is not clearly separated from the cross-correlation data). However, the disclosure is not limited thereto and the device 110 may determine the confidence value using any technique known to one of skill in the art. For example, the device 110 may compare peak to peak (e.g., magnitude of a first peak divided by a magnitude of a second peak, such as Peak1/Peak2), peak to group (e.g., magnitude of a first peak divided by an average magnitude of a group of peaks, such as Peak1/PeakGroup), group to everything else (e.g., average magnitude of a group of peaks divided by an average magnitude for all other data points, such as PeakGroup/EverythingElse), and/or the like.

The device 110 may determine (1078) whether there is an additional peak, and if so, may loop to step 1074 to repeat steps 1074-1078 for the additional peak. If the device 110 determines that there isn't an additional peak, the device 110 may identify (1080) an earliest significant peak and may determine (1082) an echo estimate based on the earliest significant peak. For example, the device 110 may determine the earliest significant peak by determining a peak having the highest confidence value, the earliest peak having a confidence value above a threshold value, and/or using techniques known to one of skill in the art.

As discussed above, in some examples the number of unique peaks in the cross-correlation data may correspond to the number of channels (e.g., loudspeakers 116). For example, 2-channel audio (e.g., stereo audio) may correspond to cross-correlation data including two peaks, 3-channel audio (e.g., left-center-right) may correspond to cross-correlation data including three peaks, 6-channel audio (e.g., 5.1 surround sound) may correspond to cross-correlation data including six peaks, and so on.

In some examples, the device 110 may detect more unique peaks than the number of channels. For example, a single loudspeaker 116 may correspond to cross-correlation data including two or more peaks, with some peaks being "significant peaks" and others being minor peaks. The additional peaks may be caused by reflections off of acoustically reflective surfaces in proximity to the device 110. Additionally or alternatively, the additional peaks may be caused by the playback audio data being sent to the loudspeakers 116 including repetitive sounds or the like. In this example, the echo latency estimate may not be accurate, as the device 110 may be unable to determine whether the peaks correspond to the reference signal repeating or to separate reference signals. In some examples, the device 110 may be configured to detect repetition in the reference signal(s) and determine whether the reference signal is valid for determining the cross-correlation, as will be described in greater detail below.

In other examples, there may be fewer unique peaks than the number of channels, such as when peaks corresponding to two or more loudspeakers 116 overlap. When there are fewer unique peaks than the number of channels, the echo latency estimate may still be accurate as the device 110 may select the earliest significant peak, even if it includes two merged peaks.

Figure 11:
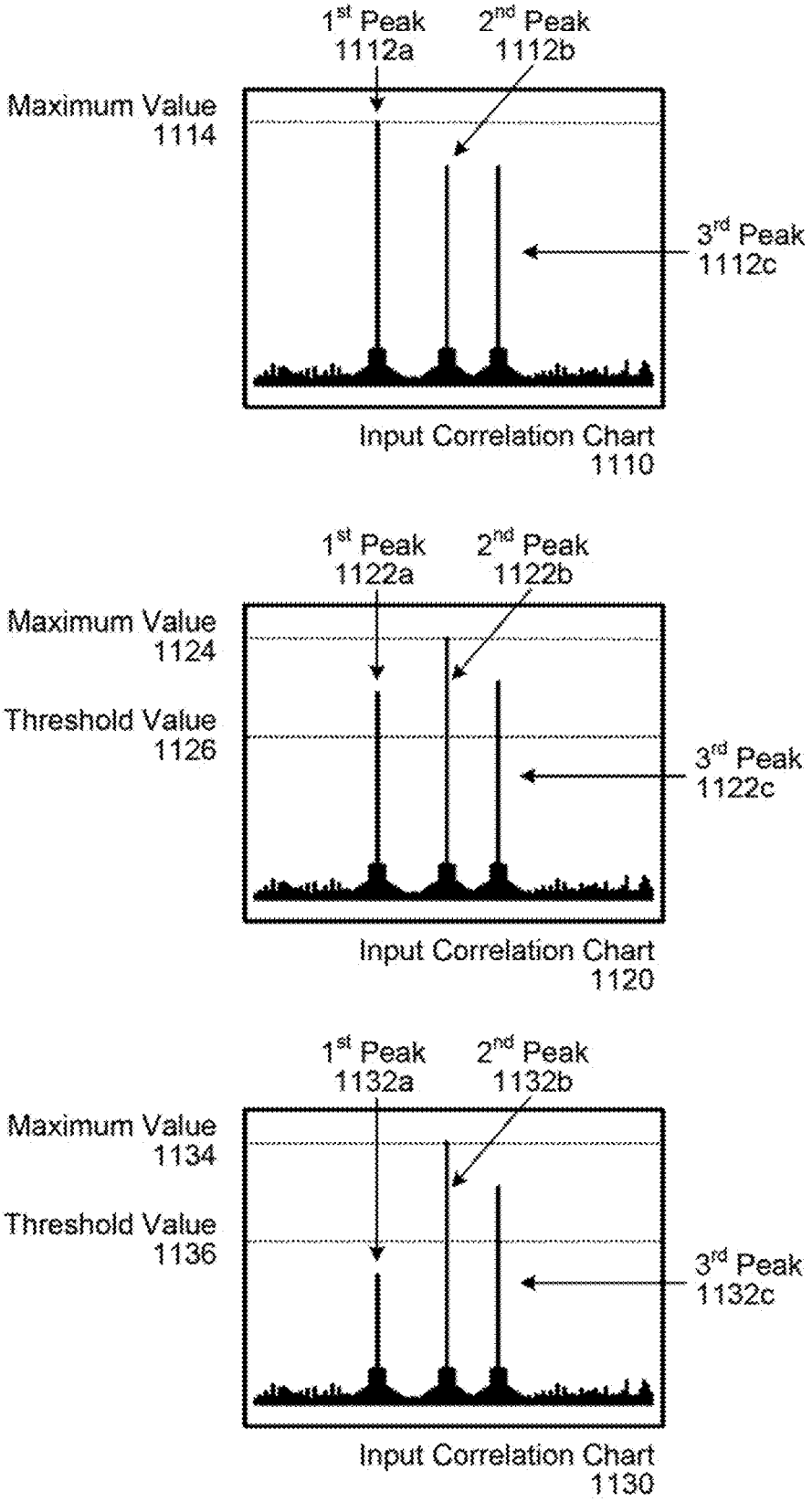
FIG. 11 illustrates examples of selecting a significant peak for latency estimation according to embodiments of the present disclosure.

FIG. 11 illustrates examples of selecting a significant peak for latency estimation according to embodiments of the present disclosure. As discussed above, the device 110 may determine a first number of unique peaks in the cross-correlation data based on the number of channels (e.g., loudspeakers 116). To estimate the echo latency, the device 110 may determine an earliest significant peak (e.g., peak preceding other peaks and having a magnitude exceeding a threshold).

To determine the earliest significant peak, the device 110 may determine a highest peak (e.g., peak with a highest magnitude) in the cross-correlation data. The device 110 may then determine if there are any unique peaks preceding the highest peak. If there are previous unique peaks, the device 110 may determine a threshold value based on the highest magnitude and may determine if the previous unique peak is above the threshold value. In some examples, the threshold value may be based on a percentage of the highest magnitude, a ratio, or the like. For example, the threshold value may correspond to a ratio of a first magnitude of the previous peak to the highest magnitude of the highest peak. Thus, if the previous peak is above the threshold value, a first ratio of the first magnitude to the highest magnitude is above the desired ratio. However, if the previous peak is below the threshold value, a second ratio of the first magnitude to the highest magnitude is below the desired ratio.

FIG. 11 illustrates a first input correlation chart 1110 that illustrates first cross-correlation data. As illustrated in the first input correlation chart 1110, the device 110 may identify a first peak 1112*a*, a second peak 1112*b*, and a third peak 1112*c*. The device 110 may determine a maximum value 1114 in the first cross-correlation data and determine that the maximum value 1114 (e.g., highest magnitude) corresponds to the first peak 1112*a*. Thus, the first peak 1112*a* is the highest peak. In this example, the device 110 may not detect any previous peaks prior to the first peak 1112*a* and may select the first peak 1112*a* as the earliest significant peak with which to determine the echo latency estimate.

Second input correlation chart 1120 illustrates second cross-correlation data that corresponds to an example where there is a previous peak prior to the highest peak. As illustrated in the second input correlation chart 1120, the device 110 may identify a first peak 1122*a*, a second peak 1122*b*, and a third peak 1122*c*. The device 110 may determine a maximum value 1124 in the second cross-correlation data and determine that the maximum value 1124 (e.g., highest magnitude) corresponds to the second peak 1122*b*. Thus, the second peak 1122*b* is the highest peak, but the device 110 may determine that the first peak 1122*a* is earlier than the second peak 1122*b*.

To determine whether the first peak 1122*a* is significant and should be used to estimate the echo latency, the device 110 may determine a threshold value 1126 based on the maximum value 1124. The device 110 may then determine a magnitude associated with the first peak 1122*a* and whether the magnitude exceeds the threshold value 1126. As illustrated in the second input correlation chart 1120, the magnitude of the first peak 1122*a* does exceed the threshold value 1126 and the device 110 may select the first peak 1122*a* as the earliest significant peak and may use the first peak 1122*a* to determine the echo latency estimate.

The example illustrated in the second input correlation chart 1120 may correspond to a weak transmitter (e.g., first loudspeaker 116*a* at a relatively lower volume and/or directed away from the microphone 114) being placed closer to the microphone 114, whereas another transmitter that is further away is generating strong signals (e.g., second loudspeaker 116*b* at a relatively higher volume and/or directed towards the microphone 114). The device 110 may detect that the second loudspeaker 116*b* corresponds to the highest peak in the second cross-correlation data (e.g., second peak 1122*b*), but may use the first peak 1122*a* to estimate the echo latency even though the first peak 1122*a* is weaker than the second peak 1122*b*.

Third input correlation chart 1130 illustrates third cross-correlation data that corresponds to another example where there is a previous peak prior to the highest peak. As illustrated in the third input correlation chart 1130, the device 110 may identify a first peak 1132*a*, a second peak 1132*b*, and a third peak 1132*c*. The device 110 may determine a maximum value 1134 in the third cross-correlation data and determine that the maximum value 1134 (e.g., highest magnitude) corresponds to the second peak 1132*b*. Thus, the second peak 1132*b* is the highest peak, but the device 110 may determine that the first peak 1132*a* is earlier than the second peak 1132*b*.

To determine whether the first peak 1132*a* is significant and should be used to estimate the echo latency, the device 110 may determine a threshold value 1136 based on the maximum value 1134. The device 110 may then determine a magnitude associated with the first peak 1132*a* and whether the magnitude exceeds the threshold value 1136. As illustrated in the third input correlation chart 1130, the magnitude of the first peak 1132*a* does not exceed the threshold value 1136 and the device 110 may not select (e.g., may ignore) the first peak 1132*a* as the earliest significant peak. Instead, the device 110 may select the second peak 1132*b* as the earliest significant peak and may use the second peak 1132*b* to determine the echo latency estimate.

While the first peak 1132*a* may correspond to audio received from a first loudspeaker 116*a*, because the first peak 1132*a* is below the threshold value 1136 the device 110 may not consider it strong enough to use to estimate the echo latency. For example, the device 110 may be unable to determine if the first peak 1132*a* corresponds to receiving audio from the loudspeakers 116 or instead corresponds to noise, repetition in the reference signal or other factors that are not associated with receiving audio from the loudspeakers 116.

The examples illustrated in FIG. 11 are provided for illustrative purposes only and the disclosure is not limited thereto. In some examples, there may be more than one peak earlier than the highest peak. For example, a fourth peak 1122*d* may be earlier than the first peak 1122*a* in the second input correlation chart 1120 and a fourth peak 1132*d* may be earlier than the first peak 1132*a* in the third input correlation chart 1130. The device 110 may repeat the process for each of the earlier peaks to determine the earliest significant peak.

As a first example, the device 110 may determine that the first peak 1122*a* is above the threshold value 1126 and may select the first peak 1122*a*. However, the device 110 may determine that the fourth peak 1122*d* is earlier than the first peak 1122*a* and may determine if the fourth peak 1122*d* is above the threshold value 1126. If the fourth peak 1122*d* is also above the threshold value 1126, the device 110 may select the fourth peak 1122*d* as the earliest significant peak. If the fourth peak 1122*d* is below the threshold value 1126, the device 110 may select the first peak 1122*a* as the earliest significant peak.

As a second example, the device 110 may determine that the first peak 1132*a* is below the threshold value 1136 and may not select the first peak 1132*a*. However, the device 110 may determine that the fourth peak 1132*d* is earlier than the first peak 1132*a* and may determine if the fourth peak 1132*d* is above the threshold value 1136. If the fourth peak 1132*d* is above the threshold value 1136, the device 110 may select the fourth peak 1132*d* as the earliest significant peak. If the fourth peak 1132*d* is below the threshold value 1136, the device 110 may select the second peak 1132*b* as the earliest significant peak.

In some examples, the device 110 may determine if the cross-correlation data includes a strong peak with which to estimate the echo latency. In some examples, a highest peak of the cross-correlation data may not be strong enough to provide an accurate estimate of the echo latency. To determine whether the highest peak is strong enough, the device 110 may take absolute values of the cross-correlation data and sort the peaks in declining order. For example, the device 110 may sort peaks included in the cross-correlation data declining order of magnitude and determine percentiles (e.g., $10^{th}$ percentile, $50^{th}$ percentile, etc.) associated with individual peaks. The device 110 may determine a ratio of a first value (e.g., highest magnitude associated with the first peak) of the cross-correlation data to a specific percentile (e.g., $10^{th}$ percentile, $50^{th}$ percentile, etc.). If the ratio is lower than a threshold value, this indicates that the first peak is only slightly larger than the specific percentile, indicating that the first peak is not strong enough (e.g., clearly defined and/or having a higher magnitude than other peaks) and the cross-correlation data is inadequate to provide an accurate estimate of the echo latency. If the ratio is higher than the threshold value, this indicates that the first peak is sufficiently larger than the specific percentile, indicating that the first peak is strong enough to provide an accurate estimate of the echo latency.

As discussed above, repetition in the reference signal(s) may result in additional unique peaks in the cross-correlation data. Thus, a first number of unique peaks in the cross-correlation data may be greater than the number of channels. Repetition in the reference signal(s) may correspond to repetitive sounds, beats, words or the like, such as a bass portion of a techno song. When the reference signal(s) include repetitive sounds, the device 110 may be unable to accurately determine the echo latency estimate as the device 110 may be unable to determine whether the peaks correspond to the reference signal repeating or to separate reference signals. In some examples, the device 110 may be configured to detect repetition in the reference signal(s) and determine whether the reference signal is valid for determining the cross-correlation.

Figure 12:
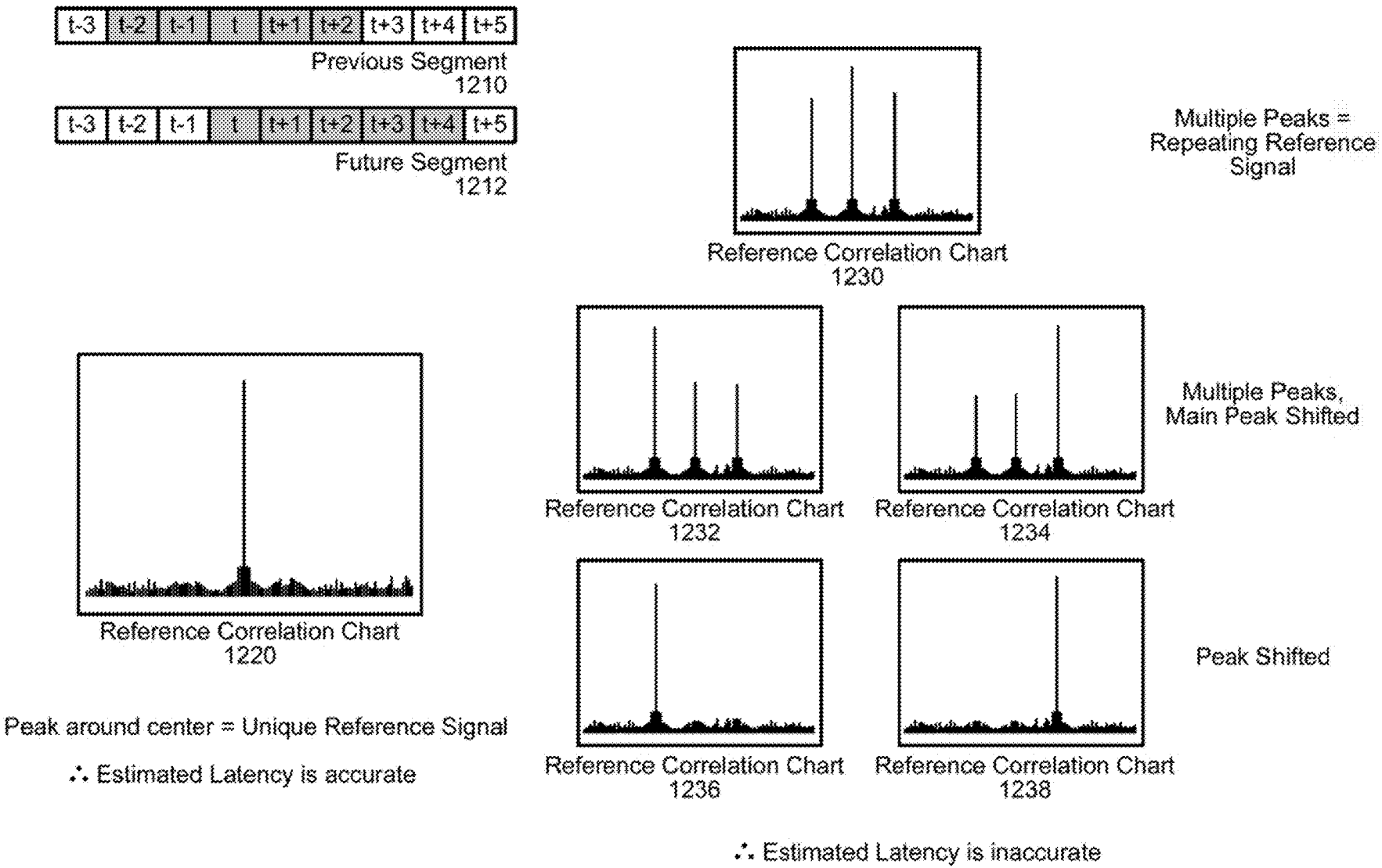
FIG. 12 illustrates an example of performing reference signal validation according to embodiments of the present disclosure.

FIG. 12 illustrates an example of performing reference signal validation according to embodiments of the present disclosure. As illustrated in FIG. 12, the device 110 may determine cross-correlation data between a previous segment 1210 and a future segment 1212 in the reference signal. In the example illustrated in FIG. 12, the device 110 may use a first time period corresponding to a max delay (e.g., 2) to determine the previous segment 1210 and the future segment 1212. For example, the previous segment 1210 corresponds to the first time period before a current time and the first time period after the current time (e.g., audio sample t−2 to audio sample t+2). Similarly, the future segment 1212 corresponds to twice the first time period after the current time (e.g., audio sample t to audio sample t+4). Thus, the previous segment 1210 and the future segment 1212 have an equal length (e.g., 5 audio samples) and overlap each other in an overlap region (e.g., audio sample t to audio sample t+2 are included in both the previous segment 1210 and the future segment 1212).

If the reference signal does not include repetitive sounds, the cross-correlation data between the previous segment 1210 and the future segment 1212 should have a single, clearly defined peak corresponding to the overlap region. If the reference signal does include repetitive sounds, however, the cross-correlation data may have multiple peaks and/or a highest peak may be offset relative to the overlap region. For example, the highest peak being offset may indicate that previous audio segments are strongly correlated to future audio segments, instead of and/or in addition to a correlation within the overlap region. If the reference signal includes repetitive sounds, the reference signal may not be useful for determining the echo latency estimate.

FIG. 12 illustrates a first reference correlation chart 1220 that represents first cross-correlation data between the previous segment 1210 and the future segment 1212 having a single peak in the overlap region. As there is a single peak corresponding to the overlap region, the first reference correlation chart 1220 corresponds to a unique reference signal and the device 110 may use the reference signal to estimate the echo latency.

In contrast, a second reference correlation chart 1230 represents second cross-correlation data between the previous segment 1210 and the future segment 1212 having multiple peaks that are not limited to the overlap region. As there are multiple peaks, the second reference correlation chart 1230 corresponds to a repeating reference signal and the device 110 may not use the reference signal to estimate the echo latency. Thus, the device 110 may not determine the echo latency estimate for a period of time corresponding to the repeating reference signal and/or may discard echo latency estimates corresponding to the repeating reference signal.

While the second reference correlation chart 1230 illustrates three peaks centered on a highest peak, in some examples the highest peak may be offset to the left or the right. A third reference correlation chart 1232 illustrates the highest peak offset to the left, which corresponds to an earlier portion (e.g., audio sample t−2 to audio sample t) in the previous segment 1210 having a strong correlation to a later portion (e.g., audio sample t to audio sample t+2) in the future segment 1212. Alternatively, a fourth reference correlation chart 1234 illustrates the highest peak offset to the right, which corresponds to the later portion in the previous segment 1210 having a strong correlation to the earlier portion in the future segment 1212.

In some examples, the reference cross-correlation data may include only a single peak that is offset. A fifth reference correlation chart 1236 illustrates an example of a single peak offset to the left, while a sixth reference correlation chart 1238 illustrates an example of a single peak offset to the right.

Figure 13:
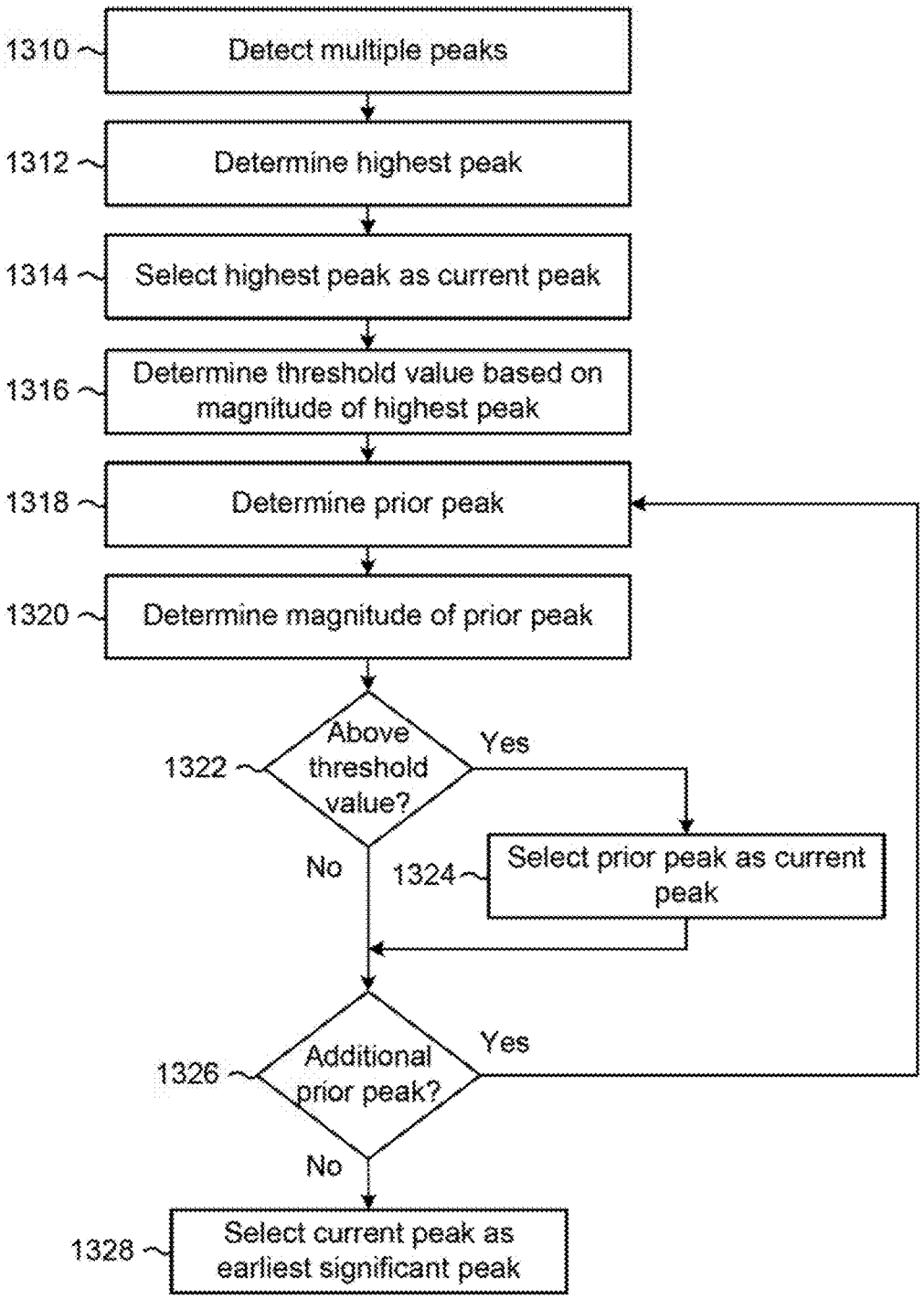
FIG. 13 is a flowchart conceptually illustrating an example method for determining a significant peak according to embodiments of the present disclosure.

FIG. 13 is a flowchart conceptually illustrating an example method for determining an earliest significant peak according to embodiments of the present disclosure. As illustrated in FIG. 13, the device 110 may detect (1310) the multiple peaks and determine (1312) the highest peak. The device 110 may select (1314) the highest peak as a current peak and determine (1316) a threshold value based on a magnitude of the highest peak.

The device 110 may determine (1318) that there is a prior peak. If the device 110 doesn't determine that there is a prior peak, the device 110 would select the highest peak as the earliest significant peak. If the device 110 determines that there is a prior peak, the device 110 may determine (1320) a magnitude of the prior peak and determine (1322) if the magnitude is above the threshold value. If the magnitude is not above the threshold value, the device 110 may skip to step 1326. If the magnitude is above the threshold value, the device 110 may select (1324) the prior peak as the current peak and proceed to step 1326. The device 110 may determine (1326) if there is an additional prior peak, and if so, may loop to step 1318 and repeat steps 1318-1326. If the device 110 determines that there is not an additional prior peak, the device 110 may select (1328) the current peak as the earliest significant peak.

For example, if the highest peak is the earliest peak (e.g., no prior peaks before the highest peak), the device 110 may select the highest peak as the earliest significant peak. If there are prior peaks that are below the threshold value, the device 110 may select the highest peak as the earliest significant peak. However, if there are prior peaks above the threshold value, the device 110 may select the prior peak as the current peak and repeat the process until the current peak is the earliest peak above the threshold value.

When the reference signals are transmitted to the loudspeakers 116 and the microphone audio data is generated by the microphone(s) 114, the microphone audio data may include noise. In some examples, the device 110 may improve the cross-correlation data between the microphone audio data and the reference audio data by applying a transformation in the frequency domain that takes into account the noise. For example, the device 110 may apply a gain to each frequency bin based on the inverse of its magnitude. Thus, the device 110 may apply the following transformation:

$$\text{Correlation}_{modified}=\text{ifft}((\text{fft}(\text{Ref})*\text{conj}(\text{fft}(\text{mic}))/\|\text{fft}(\text{mic})\|) \quad (2)$$

where $\text{Correlation}_{modified}$ is the modified cross-correlation data, fft(Ref) is a fast Fourier transform (FFT) of the reference audio data, fft(mic) is a FFT of the microphone audio data (e.g., data generated by the microphone(s) 114), conj(fft(mic)) is a conjugate of the FFT of the microphone audio data, ||fft(mic)|| is an absolute value of the FFT of the microphone audio data, and ifft is an inverse fast Fourier transform.

The microphone audio data and the reference audio data may be zero padded to avoid overlap in the FFT domain. This transformation may compensate for those frequency bands that are affected by external noise/interference, which minimizes any influence that the noise may have on the peak in the cross-correlation data. Thus, if there is noise in a particular frequency bin, equation (1) minimizes the effect of the noise. For example, if someone is speaking while classical music is being output by the loudspeakers 116, the frequency bands associated with the speech and the classical music are distinct. Thus, the device 110 may ensure that the frequency bands associated with the speech are not being added to the cross-correlation data.

Various machine learning techniques may be used to perform the training of one or models used by the device 110 to determine echo latency, select peaks or perform other functions as described herein. Models may be trained and operated according to various machine learning techniques. Such techniques may include, for example, inference engines, trained classifiers, etc. Examples of trained classifiers include conditional random fields (CRF) classifiers, Support Vector Machines (SVMs), neural networks (such as deep neural networks and/or recurrent neural networks), decision trees, AdaBoost (short for "Adaptive Boosting") combined with decision trees, and random forests. Focusing on CRF as an example, CRF is a class of statistical models used for structured predictions. In particular, CRFs are a type of discriminative undirected probabilistic graphical models. A CRF can predict a class label for a sample while taking into account contextual information for the sample. CRFs may be used to encode known relationships between observations and construct consistent interpretations. A CRF model may thus be used to label or parse certain sequential data, like query text as described above. Classifiers may issue a "score" indicating which category the data most closely matches. The score may provide an indication of how closely the data matches the category.

In order to apply the machine learning techniques, the machine learning processes themselves need to be trained. Training a machine learning component such as, in this case, one of the first or second models, requires establishing a "ground truth" for the training examples. In machine learning, the term "ground truth" refers to the accuracy of a training set's classification for supervised learning techniques. For example, known types for previous queries may be used as ground truth data for the training set used to train the various components/models. Various techniques may be used to train the models including backpropagation, statistical learning, supervised learning, semi-supervised learning, stochastic learning, stochastic gradient descent, or other known techniques. Thus, many different training examples may be used to train the classifier(s)/model(s) discussed herein. Further, as training data is added to, or otherwise changed, new classifiers/models may be trained to update the classifiers/models as desired.

Figure 14:
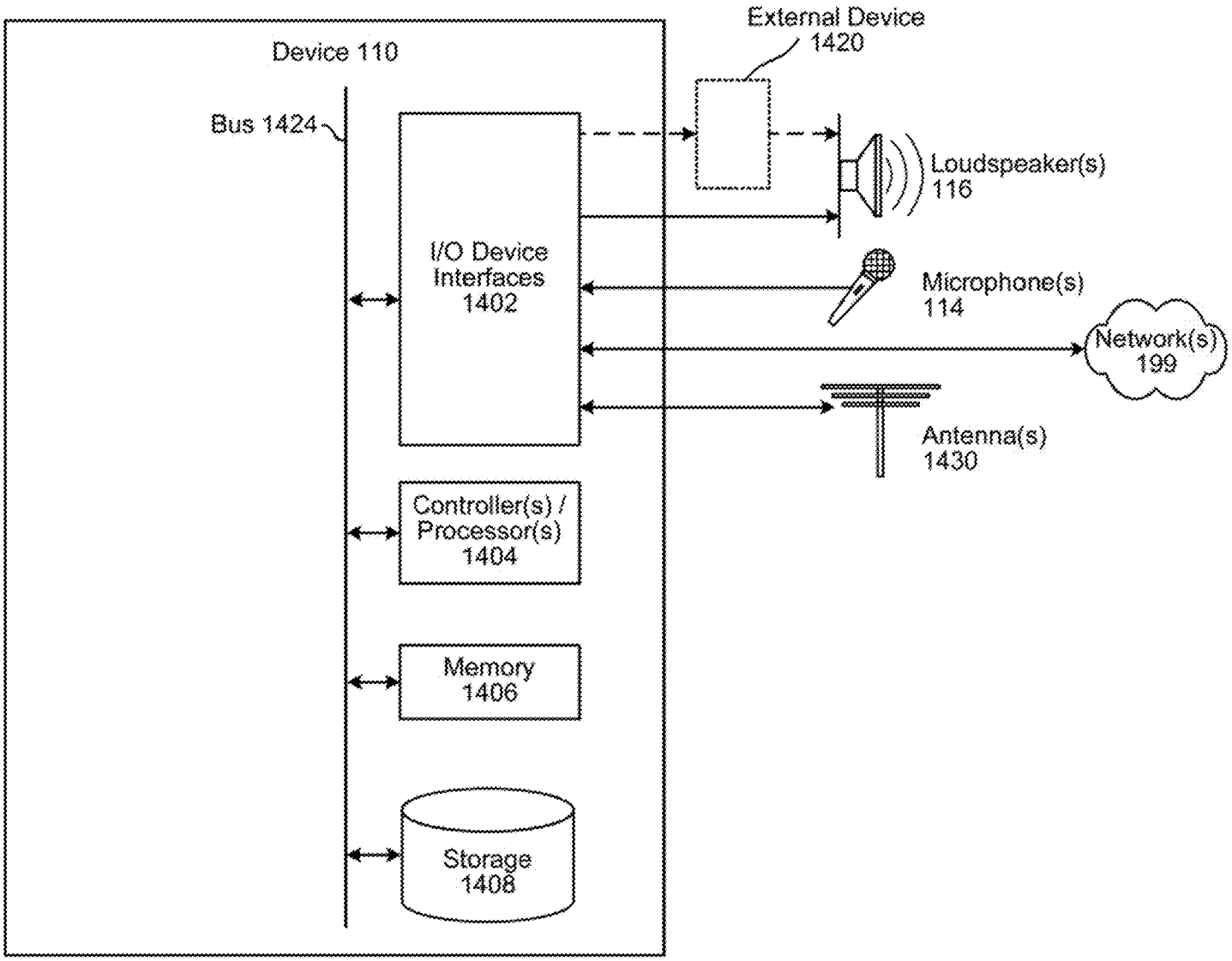
FIG. 14 is a block diagram conceptually illustrating example components of a device according to embodiments of the present disclosure.

FIG. 14 is a block diagram conceptually illustrating example components of the device 110. In operation, the device 110 may include computer-readable and computer-executable instructions that reside on the device, as will be discussed further below.

The device 110 may include one or more audio capture device(s), such as individual microphone(s) 114 and/or a microphone array that may include a plurality of microphone(s) 114. The audio capture device(s) may be integrated into a single device or may be separate. However, the disclosure is not limited thereto and the audio capture device(s) may be separate from the device 110 without departing from the disclosure. For example, the device 110 may connect to one or more microphone(s) 114 that are external to the device 110 without departing from the disclosure.

The device 110 may also include audio output device(s) for producing sound, such as loudspeaker(s) 116. The audio output device(s) may be integrated into a single device or may be separate. However, the disclosure is not limited thereto and the audio output device(s) may be separate from the device 110 without departing from the disclosure. For example, the device 110 may connect to one or more loudspeaker(s) 116 that are external to the device 110 without departing from the disclosure.

In some examples, the device 110 may not connect directly to loudspeaker(s) 116 but may instead connect to the loudspeaker(s) 116 via an external device 1420 (e.g., television, audio video receiver (AVR), other devices that perform audio processing, or the like). For example, the device 110 may send first reference audio signals to the external device 1420 and the external device 1420 may generate second reference audio signals and send the second reference audio signals to the loudspeaker(s) 116 without departing from the disclosure. The external device 1420 may change a number of channels, upmix/downmix the reference audio signals, and/or perform any audio processing known to one of skill in the art. Additionally or alternatively, the device 110 may be directly connected to first loudspeaker(s) 116 and indirectly connected to second loudspeaker(s) 116 via one or more external devices 1420 without departing from the disclosure.

While FIG. 14 illustrates the device 110 connected to audio capture device(s) and audio output device(s), the disclosure is not limited thereto. Instead, the techniques disclosed herein may be applied to other systems to provide latency estimation and/or signal matching in a variety of circumstances. For example, the device 110 may receive input data from multiple sensors and may determine how close the sensors are to each other based on the input data. Thus, the techniques disclosed herein are applicable to systems that use RADAR techniques, SONAR techniques, and/or other technology without departing from the disclosure. For example, the device 110 may be connected to antenna(s) 1430 (e.g., one or more transmitting antenna(s), one or more receiving antenna(s), and/or one or more antenna(s) that are capable of both transmitting and receiving data) without departing from the disclosure.

The device 110 may include an address/data bus 1424 for conveying data among components of the device 110. Each component within the device may also be directly connected to other components in addition to (or instead of) being connected to other components across the bus 1424.

The device 110 may include one or more controllers/processors 1404 that may each include a central processing unit (CPU) for processing data and computer-readable instructions, and a memory 1406 for storing data and instructions. The memory 1406 may include volatile random access memory (RAM), non-volatile read only memory (ROM), non-volatile magnetoresistive (MRAM) and/or other types of memory. The device 110 may also include a data storage component 1408, for storing data and controller/processor-executable instructions (e.g., instructions to perform operations discussed herein). The data storage component 1408 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1402.

Computer instructions for operating the device 110 and its various components may be executed by the controller(s)/processor(s) 1404, using the memory 1406 as temporary "working" storage at runtime. The computer instructions may be stored in a non-transitory manner in non-volatile memory 1406, storage 1408, or an external device. Alternatively, some or all of the executable instructions may be embedded in hardware or firmware in addition to or instead of software.

The device 110 may include input/output device interfaces 1402. A variety of components may be connected through the input/output device interfaces 1402, such as the loudspeaker(s) 116, the microphone(s) 114, the external device 1420, the antenna(s) 1430, a media source such as a digital media player (not illustrated), and/or the like. The input/output interfaces 1402 may include A/D converters (not shown) and/or D/A converters (not shown).

The input/output device interfaces 1402 may also include an interface for an external peripheral device connection such as universal serial bus (USB), FireWire, Thunderbolt or other connection protocol. The input/output device interfaces 1402 may also include a connection to one or more network(s) 199 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network(s) 199, the device 110 may be distributed across a networked environment.

Multiple devices may be employed in a single device 110. In such a multi-device device, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

sending reference audio data to a loudspeaker to generate output audio, the reference audio data including a first reference sample and a second reference sample;

capturing microphone audio data using a microphone, the microphone audio data including a first representation of at least a portion of the output audio;

calculating a first value of a threshold, the first value corresponding to a 99th percentile of the reference audio data during a first time period;

determining a first magnitude value corresponding to the first reference sample;

determining that the first magnitude value is below the first value, indicating that the first reference sample is below the 99th percentile;

calculating a second value of the threshold that is lower than the first value, the second value indicating the 99th percentile of the reference audio data during a second time period;

determining a second magnitude value corresponding to the second reference sample;

determining that the second magnitude value exceeds the second value, indicating that the second reference sample is at or above the 99th percentile;

generating subsampled reference audio data including the second reference sample and corresponding to portions of the reference audio data at or above the 99th percentile;

determining cross-correlation data corresponding to a cross-correlation between the subsampled reference audio data and the microphone audio data;

determining a first peak value in the cross-correlation data, the first peak value indicating a beginning of the first representation;

determining, using the first peak value, an echo delay estimate value corresponding to a delay between sending the reference audio data to the loudspeaker and the microphone capturing the first representation in the microphone audio data;

determining second reference audio data using the reference audio data and the echo delay estimate value, the second reference audio data synchronized with the microphone audio data; and subtracting the second reference audio data from the microphone audio data to generate output audio data.

2. The computer-implemented method of claim 1, wherein:

determining the echo delay estimate value further comprises:

determining a third time period associated with the first peak value, and determining the echo delay estimate value based on a difference between the third time period and a fourth time period at which the reference audio data was sent to the loudspeaker, the echo delay estimate value corresponding to a first echo path; and the method further comprises:

determining a second peak value represented in the cross-correlation data after the first peak value;

determining a fifth time period associated with the second peak value, the fifth time period after the third time period;

determining a second echo delay estimate value based on a difference between the fifth time period and the fourth time period, the second echo delay estimate value corresponding to a second echo path; and determining the second reference audio data further comprises determining the second reference audio data based on the reference audio data, the echo delay estimate value, and the second echo delay estimate value.

3. The computer-implemented method of claim 1, further comprising:

calculating the second value of the threshold by subtracting a first amount from the first value; and calculating, in response to the second magnitude value exceeding the second value, a third value of the threshold by adding a second amount to the second value, the third value indicating the 99th percentile of the reference audio data during a third time period after the second time period, wherein:

the 99th percentile corresponds to a first number having a value of 0.99;

a complement of the 99th percentile corresponds to a second number having a value of 0.01;

the second amount corresponds to a first product of the first number and a coefficient value; and the first amount corresponds to a second product of the second number and the coefficient value.

4. The computer-implemented method of claim 1, further comprising:

calculating the second value of the threshold by subtracting a first amount from the first value;

calculating, in response to the second magnitude value exceeding the second value, a third value of the threshold by adding a second amount to the second value, the third value indicating the 99th percentile of the reference audio data during a third time period after the second time period;

calculating a fourth value of the threshold during a fourth time period, the fourth time period corresponding to a steady state condition;

determining a third magnitude value corresponding to a third reference sample;

determining that the third magnitude value exceeds the fourth value, indicating that the third reference sample is at or above the 99th percentile; and calculating a fifth value of the threshold by adding a third amount to the fourth value, the fifth value indicating the 99th percentile of the reference audio data during a fifth time period after the fourth time period.

5. A computer-implemented method, the method comprising:

receiving reference audio data corresponding to output audio generated by at least one loudspeaker, the reference audio data including a first sample and a second sample;

receiving microphone audio data from at least one microphone, the microphone audio data including a representation of the output audio;

determining a first magnitude value based on the first sample;

determining that the first magnitude value is below a desired percentile associated with the reference audio data;

determining a second magnitude value based on the second sample;

determining that the second magnitude value is at or above the desired percentile associated with the reference audio data;

generating subsampled reference audio data including the second sample and corresponding to portions of the reference audio data that are at or above the desired percentile; and determining an echo delay estimate value based on the subsampled reference audio data and the microphone audio data.

6. The computer-implemented method of claim 5, further comprising:

determining second reference audio data based on the reference audio data and the echo delay estimate value, the second reference audio data synchronized with the microphone audio data; and generating output audio data by subtracting at least a portion of the second reference audio data from the microphone audio data.

7. The computer-implemented method of claim 5, wherein:

determining that the first magnitude value is below the desired percentile further comprises:

determining a first estimate value of the desired percentile during a first time period, and determining that the first magnitude value is below the first estimate value; and the method further comprises determining a second estimate value by subtracting a first amount from the first estimate value, the second estimate value corresponding to the desired percentile during a second time period after the first time period.

8. The computer-implemented method of claim 7, wherein:

determining that the second magnitude value is at or above the desired percentile further comprises determining that the second magnitude value exceeds the second estimate value;

the method further comprises determining a third estimate value by adding a second amount to the second magnitude value, the third estimate value corresponding to the desired percentile during a third time period after the second time period; and generating the subsampled reference audio data further comprises adding the second sample to the subsampled reference audio data.

9. The computer-implemented method of claim 5, wherein:

determining that the second magnitude value is at or above the desired percentile further comprises:

determining a first estimate value of the desired percentile during a first time period, and determining that the second magnitude value exceeds the first estimate value;

the method further comprises determining a second estimate value by adding a first amount to the first estimate value, the second estimate value corresponding to the desired percentile during a second time period after the first time period; and generating the subsampled reference audio data further comprises adding the second sample to the subsampled reference audio data.

10. The computer-implemented method of claim 5, wherein determining the echo delay estimate value further comprises:

determining cross-correlation data corresponding to a cross-correlation between the subsampled reference audio data and the microphone audio data;

determining a first time period corresponding to the reference audio data being sent to at least one loudspeaker;

determining a first peak value represented in the cross-correlation data, the first peak value corresponding to a highest magnitude of the cross-correlation data within a first range;

determining a second time period associated with the first peak value; and determining the echo delay estimate value based on a difference between the second time period and the first time period, the echo delay estimate value corresponding to a delay between sending a first portion of the reference audio data to the at least one loudspeaker and at least one microphone capturing a second portion of the microphone audio data corresponding to the first portion of the reference audio data.

11. The computer-implemented method of claim 10, further comprising:

determining a second peak value represented in the cross-correlation data, the second peak value corresponding to a highest magnitude of the cross-correlation data within a second range;

determining a third time period associated with the second peak value, the third time period after the second time period;

determining a second echo delay estimate value based on a difference between the third time period and the first time period, the second echo delay estimate value corresponding to a second echo path;

determining second reference audio data based on the reference audio data, the echo delay estimate value, and the second echo delay estimate value; and generating output data by performing echo cancellation on the microphone audio data using the second reference audio data.

12. The computer-implemented method of claim 5, further comprising:

determining a first estimate value of the desired percentile during a first time period;

determining a second estimate value by subtracting a first amount from the first estimate value, the second estimate value corresponding to the desired percentile during a second time period after the first time period;

determining a third estimate value of the desired percentile during a third time period; and determining a fourth estimate value by subtracting a second amount from the third estimate value, the fourth estimate value corresponding to the desired percentile during a fourth time period after the third time period.

13. A system comprising:

at least one processor; and memory including instructions operable to be executed by the at least one processor to cause the system to:

receive reference audio data corresponding to output audio generated by at least one loudspeaker, the reference audio data including a first sample and a second sample;

receive microphone audio data from at least one microphone, the microphone audio data including a representation of the output audio;

determine a first magnitude value based on the first sample;

determine that the first magnitude value is below a desired percentile associated with the reference audio data;

determine a second magnitude value based on the second sample;

determine that the second magnitude value is at or above the desired percentile associated with the reference audio data;

generate subsampled reference audio data including the second sample and corresponding to portions of the reference audio data that are at or above the desired percentile; and determine an echo delay estimate value based on the subsampled reference audio data and the microphone audio data.

14. The system of claim 13, wherein the memory further comprises instructions that, when executed by the at least one processor, further cause the system to:

determine second reference audio data based on the reference audio data and the echo delay estimate value, the second reference audio data synchronized with the microphone audio data; and generate output audio data by subtracting at least a portion of the second reference audio data from the microphone audio data.

15. The system of claim 13, wherein the memory further comprises instructions that, when executed by the at least one processor, further cause the system to:

determine a first estimate value of the desired percentile during a first time period;

determine that the first magnitude value is below the first estimate value; and determine a second estimate value by subtracting a first amount from the first estimate value, the second estimate value corresponding to the desired percentile during a second time period after the first time period.

16. The system of claim 15, wherein the memory further comprises instructions that, when executed by the at least one processor, further cause the system to:

determine that the second magnitude value exceeds the second estimate value;

determine a third estimate value by adding a second amount to the second magnitude value, the third estimate value corresponding to the desired percentile during a third time period after the second time period; and generate the subsampled reference audio data further comprises adding the second sample to the subsampled reference audio data.

17. The system of claim 13, wherein the memory further comprises instructions that, when executed by the at least one processor, further cause the system to:

determine a first estimate value of the desired percentile during a first time period;

determine that the second magnitude value exceeds the first estimate value;

determine a second estimate value by adding a first amount to the first estimate value, the second estimate value corresponding to the desired percentile during a second time period after the first time period; and generate the subsampled reference audio data further comprises adding the second sample to the subsampled reference audio data.

18. The system of claim 13, wherein the memory further comprises instructions that, when executed by the at least one processor, further cause the system to:

determine cross-correlation data corresponding to a cross-correlation between the subsampled reference audio data and the microphone audio data;

determine a first time period corresponding to the reference audio data being sent to at least one loudspeaker;

determine a first peak value represented in the cross-correlation data, the first peak value corresponding to a highest magnitude of the cross-correlation data within a first range;

determine a second time period associated with the first peak value; and determine the echo delay estimate value based on a difference between the second time period and the first time period, the echo delay estimate value corresponding to a delay between sending a first portion of the reference audio data to the at least one loudspeaker and at least one microphone capturing a second portion of the microphone audio data corresponding to the first portion of the reference audio data.

19. The system of claim 18, wherein the memory further comprises instructions that, when executed by the at least one processor, further cause the system to:

determine a second peak value represented in the cross-correlation data, the second peak value corresponding to a highest magnitude of the cross-correlation data within a second range;

determine a third time period associated with the second peak value, the third time period after the second time period;

determine a second echo delay estimate value based on a difference between the third time period and the first time period, the second echo delay estimate value corresponding to a second echo path;

determine second reference audio data based on the reference audio data, the echo delay estimate value, and the second echo delay estimate value; and generate output data by performing echo cancellation on the microphone audio data using the second reference audio data.

20. The system of claim 13, wherein the memory further comprises instructions that, when executed by the at least one processor, further cause the system to:

determine a first estimate value of the desired percentile during a first time period;

determine a second estimate value by subtracting a first amount from the first estimate value, the second estimate value corresponding to the desired percentile during a second time period after the first time period;

determine a third estimate value of the desired percentile during a third time period; and determine a fourth estimate value by subtracting a second amount from the third estimate value, the fourth estimate value corresponding to the desired percentile during a fourth time period after the third time period.

* * * * *